US010231072B2

(12) United States Patent
Takahashi

(10) Patent No.: US 10,231,072 B2
(45) Date of Patent: Mar. 12, 2019

(54) INFORMATION PROCESSING TO MEASURE VIEWING POSITION OF USER

(71) Applicant: SONY CORPORATION, Tokyo (JP)

(72) Inventor: Naoya Takahashi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/303,764

(22) PCT Filed: Mar. 12, 2015

(86) PCT No.: PCT/JP2015/057328
§ 371 (c)(1),
(2) Date: Oct. 13, 2016

(87) PCT Pub. No.: WO2015/163031
PCT Pub. Date: Oct. 29, 2015

(65) Prior Publication Data

US 2017/0034642 A1 Feb. 2, 2017

(30) Foreign Application Priority Data

Apr. 23, 2014 (JP) ..... 2014-089337

(51) Int. Cl.
*H04R 3/04* (2006.01)
*H04R 3/12* (2006.01)
(Continued)

(52) U.S. Cl.
CPC ..... *H04S 7/303* (2013.01); *G10K 15/00* (2013.01); *H04R 3/04* (2013.01); *H04R 3/12* (2013.01);
(Continued)

(58) Field of Classification Search
None
See application file for complete search history.

(56) References Cited

U.S. PATENT DOCUMENTS

2009/0285404 A1* 11/2009 Hsu ..... H04S 7/303 381/28
2010/0135118 A1* 6/2010 Van Leest ..... H04S 7/301 367/124
(Continued)

FOREIGN PATENT DOCUMENTS

JP 01-319173 A 12/1989
JP 2005-151422 A 6/2005
(Continued)

OTHER PUBLICATIONS

International Preliminary Report on Patentability of PCT Application No. PCT/JP2015/057328, dated Oct. 25, 2016, 1 pages of English Translation and 3 pages of ISRWO.
(Continued)

*Primary Examiner* — Curtis A Kuntz
*Assistant Examiner* — Kenny H Truong
(74) *Attorney, Agent, or Firm* — Chip Law Group

(57) ABSTRACT

Provided is an information processing device including: an audio signal output unit that causes measuring audio in an inaudible band to be output from a speaker; and a viewing position computation unit that computes a viewing position of a user based on the measuring audio picked up by a microphone.

12 Claims, 15 Drawing Sheets

(51) Int. Cl.

| | |
|---|---|
| ***H04S 5/02*** | (2006.01) |
| ***H04S 7/00*** | (2006.01) |
| ***G10K 15/00*** | (2006.01) |
| ***H04R 29/00*** | (2006.01) |

(52) U.S. Cl.
CPC ..... *H04R 29/001* (2013.01); *H04S 5/02* (2013.01); *H04S 7/307* (2013.01); *H04R 2499/11* (2013.01); *H04S 2400/13* (2013.01)

(56) References Cited

U.S. PATENT DOCUMENTS

| | | | | |
|---|---|---|---|---|
| 2013/0066453 | A1* | 3/2013 | Seefeldt ..... | H04S 7/301<br>700/94 |
| 2015/0036847 | A1* | 2/2015 | Donaldson ..... | H04S 7/303<br>381/303 |

FOREIGN PATENT DOCUMENTS

| | | | |
|---|---|---|---|
| JP | 2007-259391 | A | 10/2007 |
| JP | 2009-267687 | A | 11/2009 |

OTHER PUBLICATIONS

International Search Report and Written Opinion of PCT Application No. PCT/JP2015/057328, dated Apr. 21, 2015, 6 pages of English Translation and pages of ISRWO.

* cited by examiner

INFORMATION PROCESSING TO MEASURE VIEWING POSITION OF USER

CROSS REFERENCE TO RELATED APPLICATIONS

This application is a U.S. National Phase of International Patent Application No. PCT/JP2015/057328 filed on Mar. 12, 2015, which claims priority benefit of Japanese Patent Application No. JP 2014-089337 filed in the Japan Patent Office on Apr. 23, 2014. Each of the above-referenced applications is hereby incorporated herein by reference in its entirety.

TECHNICAL FIELD

The present disclosure relates to an information processing device, an information processing method, and a program.

BACKGROUND ART

In systems for viewing content such as video content and music content, there is known technology that measures the position of the viewer (user), and based on the measured position of the user, conducts acoustic correction on a music signal so that a more suitable sound field is reproduced in the user's viewing environment. For example, Patent Literature 1 discloses an audio set that picks up a measurement sound output from multiple speakers while varying the position of a pair of microphones, and measures the relative position between the speakers and the pair of microphones based on the picked-up signal. As another example, Patent Literature 2 discloses an audio-visual (AV) system that emits an ultrasonic wave from at least one of multiple speakers, and detects a user based on changes in the echo pattern of the received ultrasonic wave.

CITATION LIST

Patent Literature

Patent Literature 1: JP 2007-28437A
Patent Literature 2: JP 2007-520141A

SUMMARY OF INVENTION

Technical Problem

However, with the technology described in Patent Literature 1, viewing must be interrupted temporarily while the measurement sound for measuring the user's viewing position is being output from the speakers. Also, every time the user changes the viewing position, it is necessary to interrupt playback of the music signal and conduct the process of measuring the user's viewing position, which is not very convenient for the user. Also, with the technology described in Patent Literature 2, since the echo pattern of an ultrasonic wave is used to perform measurement, although it is possible to detect the user's presence, it is difficult to specify the user's viewing position.

In light of the above circumstances, there is demand for a technology that measures a user's viewing position without reducing user convenience, in order to realize a suitable sound field in a viewing environment. Accordingly, the present disclosure proposes a new and improved information processing device, information processing method, and program capable of measuring the user's viewing position without reducing user convenience.

Solution to Problem

According to the present disclosure, there is provided an information processing device including: an audio signal output unit that causes measuring audio in an inaudible band to be output from a speaker; and a viewing position computation unit that computes a viewing position of a user based on the measuring audio picked up by a microphone.

According to the present disclosure, there is provided an information processing method including: causing, by a processor, measuring audio in an inaudible band to be output from a speaker; and computing, by a processor, a viewing position of a user based on the measuring audio picked up by a microphone.

According to the present disclosure, there is provided a program causing a processor of a computer to realize: a function of causing measuring audio in an inaudible band to be output from a speaker; and a function of computing a viewing position of a user based on the measuring audio picked up by a microphone.

According to the present disclosure, measuring audio in an inaudible band is output from a speaker, and the user's viewing position is computed from the measuring audio picked up by a microphone. Consequently, even if the user is currently viewing content, it becomes possible to measure the viewing position without interfering with the viewing of the content and without the user noticing.

Advantageous Effects of Invention

According to the present disclosure as described above, it is possible to measure the user's viewing position without reducing user convenience. Note that the effects described above are not necessarily limitative. With or in the place of the above effects, there may be achieved any one of the effects described in this specification or other effects that may be grasped from this specification.

DESCRIPTION OF EMBODIMENT(S)

Figure 1:
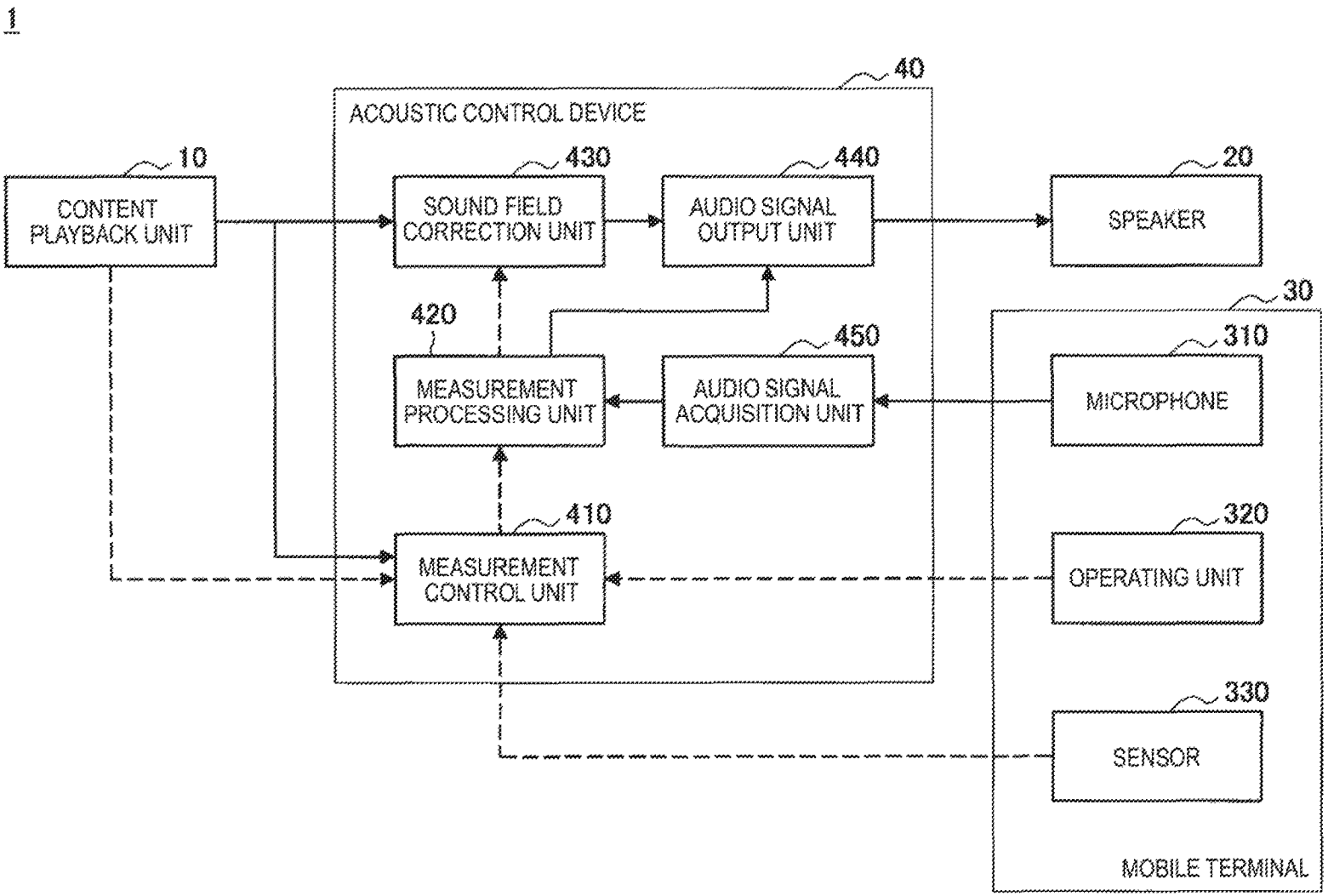
FIG. 1 is a block diagram illustrating one example configuration of a viewing system according to a first embodiment.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

Hereinafter, the description will proceed in the following order.

1. Background leading up to the present disclosure
2. First Embodiment
2-1. Overall configuration of system
2-2. Measurement processing unit
2-3. Sound field correction unit
2-4. Measurement control unit
2-5. Information processing method
3. Second Embodiment
3-1. Configuration of system
3-2. Information processing method
4. Modifications
4-1. Modification of measurement control signal
4-2. Modification of device configuration
5. Hardware configuration
6. Supplemental remarks (1. Background Leading Up to the Present Disclosure)

First, before describing a preferred embodiment of the present disclosure, the background leading up to the inventors' conceiving of the present disclosure will be described.

In a viewing system for viewing content such as video content and music content, it is comparatively easy for the viewer (user) to determine whether the sense of presence and sound quality are good or bad. For example, when the user is listening to music content performed by an orchestra, preferably a sound field is generated so that the positions of the individual instruments in the virtual sound field may be perceived more distinctly, and the user is able to imagine that a real orchestra is performing in front of the user's eyes. Also, for video content, preferably the orientation of the video and the audio is matched. Note that in this specification, "viewing" does not necessarily mean both watching and listening to content. In this specification, "viewing" may mean watching certain content, may mean listening to certain content, or may mean both.

For example, systems such as 2 channel stereo and 5.1 channel stereo viewing systems exist in which the volume balance of each of the signal channels of a 2 channel stereo signal made up of an L signal and an R signal are adjusted and output from two speakers so that the sound image of the playback sound field is oriented in an optimal location as a virtual sound image. In televisions and audio component systems adopting these methods, the user's viewing position is presupposed, and the design and parameters are adjusted so that an optimal sound field is reproduced at that position. However, the user is not necessarily limited to viewing content at the presupposed viewing position, and depending on factors such as the shape of the room and the arrangement of furniture, the viewing position may be different from the presupposed position in many cases. In such cases, the disparity in the distance between each speaker and the viewing position increases, and thus a difference is produced in the arrival times of the music signal, which may upset greatly the balance of the sound field. For this reason, there is a risk that a large disparity in the sound image position may occur, and result in sound lacking a sense of depth, or unnatural sound that is inconsistent with the video.

Accordingly, there is known technology that conduct acoustic correction on a music signal according to the environment in which the user actually uses the viewing system, so that a playback sound field as close as possible (as envisioned by the design) to a suitable sound field is brought forth. With this technology, first, the acoustic characteristics in the viewing environment are measured, and based on the measurement results, signal processing parameters for performing acoustic correction (hereinafter also called sound field correction parameters) are set in the audio output subsystem of the audio set. Subsequently, a music signal subjected to signal processing in accordance with the set sound field correction parameters is output from one or more speakers, thereby reproducing a favorable sound field that has been corrected to conform to the viewing environment.

Such acoustic correction conceivably may involve correcting a delay time (delay amount) applied to each music signal according to the arrival time (or in other words, the distance) from each speaker to the viewing position, so that the music corresponding to the music signal of each channel output from each speaker arrives at the user's viewing position at nearly the same time, for example. There is known technology that measures the user's viewing position, and conducts acoustic correction according to the distance from a speaker to the viewing position, such as the technology described in Patent Literature 1 discussed earlier, for example.

However, the technology described in Patent Literature 1 picks up a measurement sound output from multiple speakers at multiple locations while varying the position of a pair of microphones, and based on the picked-up signal, computes the coordinates of the speakers with respect to the pair of microphones in the viewing environment. Consequently, to measure the user's viewing position, the playback of video content or music content must be interrupted temporarily, and the above measurement process must be conducted in a state in which the user is wearing a microphone, for example. Additionally, the above measurement process is to be conducted every time the user changes viewing position, and thus imposes a large burden on the user. Furthermore, there is a possibility that the measurement sound itself may be unpleasant to the user. Meanwhile, the above Patent Literature 2 discloses a technology that detects the user by utilizing an ultrasonic echo pattern, but according to the basic principle of this technology, even though the user's presence may be detected, it is not considered possible to specify the user's position.

Based on the results of investigating the existing technologies above, the inventors conceived the preferable embodiments of the present disclosure indicated hereinafter as a result of thorough investigation into technology that measures the user's viewing position and realizes a suitable sound field without reducing user convenience. The following describes in detail preferred embodiments of the present disclosure conceived by the inventors. Note that in following describes an embodiment of the present disclosure by taking as an example a case in which music content is played back on a viewing system, and the user views the music content. However, the present embodiment is not limited to such an example, and the content played back on a viewing system according to the present embodiment may also be video content.

(2. First Embodiment)

(2-1. Overall Configuration of System)

An overall configuration of a viewing system according to a first embodiment of the present disclosure will be described with reference to FIG. 1. FIG. 1 is a block diagram illustrating one example configuration of a viewing system according to the first embodiment.

Referring to FIG. 1, the viewing system 1 according to the first embodiment is equipped with a content playback unit 10, a speaker 20, a mobile terminal 30, and an acoustic control device 40. The content playback unit 10, the speaker 20, the mobile terminal 30, and the acoustic control device 40 are communicably connected and able to communicate various types of signals with each other in a wired or wireless manner. Note that in FIG. 1, solid arrows indicate the transmission and reception between respective components of audio signals related to music content (hereinafter also called music signals), whereas dashed arrows indicate the transmission and reception between respective components of various other types of signals (such as control signals indicating instructions and information about parameters, for example).

The content playback unit 10 is made up of playback equipment capable of playing back music content, such as a Compact Disc (CD) player, a Digital Versatile Disc (DVD) player, or a Blu-ray (registered trademark) player, for example, and plays back content recorded on various types of recording media. The content playback unit 10 is able to read out, from a recording medium, a music signal recorded according to various types of recording methods. For example, if the medium is a DVD, the music signal is compressed and recorded according to various methods conforming to the DVD standard, such as DVD-Audio or Audio Code 3 (AC3). The content playback unit 10 may include a function of decoding a compressed music signal according to a corresponding method. Note that the media from which the content playback unit 10 is able to read out a music signal and the methods of compressing a music signal onto such media are not limited to the above examples, and the content playback unit 10 may be capable of reading out a music signal recorded by various types of compression methods onto various types of existing media. Note that the content playback unit 10 is not limited to playing back music content recorded onto media, and may also be equipment capable of playing back streaming content streamed over a network, for example.

The content playback unit 10 transmits a playback music signal to a sound field correction unit 430 of the acoustic control device 40 discussed later. With the sound field correction unit 430, acoustic correction is performed as appropriate on the music signal to realize a suitable sound field, and the corrected music signal is output to the speaker 20 by an audio signal output unit 440 discussed later. In addition, the content playback unit 10 may also transmit the playback music signal to a measurement control unit 410 of the acoustic control device 40 discussed later. In the measurement control unit 410, a parameter ("S" discussed later) expressing the music signal used in a process of measuring the user's viewing position may be extracted. Additionally, the content playback unit 10 may also transmit information about the playback status of the music content (such as play, pause, fast forward, and rewind, for example) to the measurement control unit 410. In the measurement control unit 410, whether or not to conduct the process of measuring the user's viewing position may be determined based on the information about the playback status of the music content.

The speaker 20 causes a diaphragm to vibrate according to an audio signal output from the audio signal output unit 440 discussed later, and thereby outputs audio corresponding to the audio signal. Hereinafter, the action of the speaker 20 outputting audio corresponding to the signal of an audio signal will also be referred to as outputting the audio signal, for the sake of simplicity and convenience. Also, for a microphone 310 discussed later, the action of the microphone 310 picking up sound corresponding to an audio signal similarly will also be referred to as picking up the audio signal, for the sake of convenience. Herein, in the first embodiment, the audio signal output unit 440 may also superimpose a measurement signal discussed later onto a music signal and output to the speaker 20. In this way, the audio signal output by the speaker 20 may include a music signal included in music content, as well as a measurement signal.

The mobile terminal 30 is an example of an information processing device that may be carried by the user. The mobile terminal 30 may be a mobile terminal such as a smartphone or a tablet personal computer (PC), for example, and may also be an eyeglasses-type or wristwatch-type wearable terminal that is used by being worn on the user's body. The following description will take the case of the mobile terminal 30 being a smartphone as an example. However, the type of the mobile terminal 30 is not limited to such an example, and various types of known information processing devices may be applied as the mobile terminal 30, insofar as the device is an information processing device that the user could be expected to carry around from day to day.

The mobile terminal 30 is equipped with a microphone 310, an operating unit 320, and a sensor 330. Note that, although omitted from the drawings for the sake of simplicity, the mobile terminal 30 additionally may be equipped with various components that may be installed in a typical smartphone. For example, the mobile terminal 30 may be equipped with components such as a control unit that conducts various types of signal processing and controls the operation of the mobile terminal 30, a communication unit that exchanges various types of information in a wired or wireless manner with other devices, and a storage unit that stores various types of information processed in the mobile terminal 30.

The microphone 310 picks up audio, and converts the picked-up audio into an electrical signal. Hereinafter, a signal corresponding to audio picked up by the microphone 310 will also be called a pickup signal. In the first embodiment, the microphone 310 picks up an audio signal output by the speaker 20. Herein, in the first embodiment, it is supposed that the mobile terminal 30 is being held by the user or placed a close distance from the user. Consequently, the microphone 310 of the mobile terminal 30 may pick up audio in the user's viewing environment for the viewing system 1, and the position of the microphone 310 may be considered to indicate the user's viewing position.

Note that in the first embodiment, at least one of the speaker 20 and the microphone 310 is provided in plural. As described in (2-2. Measurement processing unit) below, this is because, in the first embodiment, the distance between the speaker 20 and the microphone 310 may be computed, and thus if at least one of the speaker 20 and the microphone 310 is provided in plural, the relative position between the speaker 20 and the microphone 310 may be computed using trigonometry, for example. Computing the relative position between the speaker 20 and the microphone 310 means, in other words, computing the user's viewing position with respect to the speaker 20. For example, if the speaker 20 is provided in plural, it is sufficient for the user to have one mobile terminal 30 (a smartphone, for example). On the other hand, if only one speaker 20 is provided, it is preferable for the user to have a mobile terminal 30 equipped with multiple microphones 310, or multiple mobile terminals 30 (a smartphone and a wearable terminal, for example) each equipped with a microphone 310 and for which the relative position is known (or for which the relative position may be supposed).

The operating unit 320 is an input interface that accepts the user's operating input with respect to the mobile terminal 30. The operating unit 320 may be made up of input devices such as a touch panel and switches or the like, for example. Through the operating unit 320, the user is able to input various types of information into the mobile terminal 30, and input instructions for conducting various types of processes. The operating unit 320 is able to transmit information indicating that operating input was provided by the user to the measurement control unit 410 of the acoustic control device 40 discussed later.

The sensor 330 is any of various types of sensors, such as an acceleration sensor, a gyro sensor, a geomagnetic sensor, an optical sensor, and/or a Global Positioning System (GPS) sensor, for example. Based on output values from the sensor 330, the mobile terminal 30 is able to ascertain its own movement state (such as orientation, position, and motion). The sensor 330 is able to transmit information indicating the movement state of the mobile terminal 30 to the measurement control unit 410 of the acoustic control device 40 discussed later.

The acoustic control device 40 (which corresponds to an information processing device of the present disclosure) controls the acoustic characteristics in the user's viewing environment for the viewing system 1. The acoustic control device 40 may be what is called an AV amp, for example. The acoustic control device 40 causes measuring audio in an inaudible band to be output from the speaker 20, and in addition, computes the user's viewing position based on the measuring audio picked up by the microphone 310. In addition, based on the computed viewing position, the acoustic control device 40 may also compute sound field correction parameters for correcting a music signal in an audible band, and use the sound field correction parameters to correct the music signal. Hereinafter, the series of processes for outputting measuring audio and computing the user's viewing position will also be called the process of measuring the user's viewing position, or simply the measurement process. Note that the measurement process may also include a process of computing sound field correction parameters.

Hereinafter, a configuration of the acoustic control device 40 will be described in detail. Functionally, the acoustic control device 40 includes a measurement control unit 410, a measurement processing unit 420, a sound field correction unit 430, an audio signal output unit 440, and an audio signal acquisition unit 450. Note that these functions may be realized by having any of various types of processors constituting the acoustic control device 40, such as a central processing unit (CPU) or a digital signal processor (DSP), operate by following a certain program.

The measurement control unit 410 determines whether or not to conduct the measurement process based on a certain condition, and provides the measurement processing unit 420 with a control signal indicating to conduct the measurement process (hereinafter also called the measurement control signal). Herein, the measurement control unit 410 may determine whether or not to start the measurement process, or in other words, whether or not to output the measurement control signal, based on information such as information indicating operating input on the mobile terminal 30 by the user transmitted from the operating unit 320 of the mobile terminal 30, information indicating the movement state of the mobile terminal 30 transmitted from the sensor 330, and/or information about the playback status of music content transmitted from the content playback unit 10, for example. Additionally, the measurement control unit 410 manages various types of parameters used when conducting the measurement process (such as "S" expressing the music signal and "M" expressing the characteristics of the microphone 310 discussed later, for example), and is able to provide these parameters together with the measurement control signal to the measurement processing unit 420. The functions of the measurement control unit 410 will be described in detail in (2-4. Measurement control unit) below.

The measurement processing unit 420 conducts various processes related to the measurement process. The measurement processing unit 420 executes the measurement process according to the measurement control signal provided by the measurement control unit 410. Specifically, after receiving the measurement control signal, the measurement processing unit 420 uses various parameters provided by the measurement control unit 410 to generate an audio signal corresponding to the measuring audio in an inaudible band (hereinafter also called the measurement signal), and causes the generated audio signal to be output from the speaker 20 via the audio signal output unit 440. Additionally, the measurement processing unit 420 computes the user's viewing position based on a pickup signal from the microphone 310 of the mobile terminal 30 acquired by the audio signal acquisition unit 450. Furthermore, the measurement processing unit 420 may also computed sound field correction parameters for correcting a music signal based on the computed user's viewing position. The measurement processing unit 420 provides the computed sound field correction parameters to the sound field correction unit 430. The functions of the measurement processing unit 420 will be described in detail in (2-2. Measurement processing unit) below.

The sound field correction unit 430 corrects a music signal transmitted from the content playback unit 10 based on the sound field correction parameters computed by the measurement processing unit 420. For example, based on the sound field correction parameters, the sound field correction unit 430 is able to perform various corrections related to the sound field on the music signal, such as channel balance correction, phase correction (time alignment), and virtual surround correction. The sound field correction unit 430 causes the corrected music signal to be output from the speaker 20 via the audio signal output unit 440. Note that when the process of measuring the user's viewing position has not been conducted, the sound field correction parameters have not been computed or updated, and thus the sound field correction unit 430 may provide the music signal to the audio signal output unit 440 in an uncorrected state, or in a corrected state based on the currently set sound field correction parameters. The functions of the sound field correction unit 430 will be described in detail in (2-3. Sound field correction unit) below.

The audio signal output unit 440 outputs an audio signal to the speaker 20, and causes the speaker 20 to output audio corresponding to the audio signal. The audio signal output unit 440 is able to cause the speaker 20 to output any of a music signal (including music signals that have been corrected appropriately by the sound field correction unit 430, and uncorrected music signals), a measurement signal generated by the measurement processing unit 420, and an audio signal in which such a music signal and such a measurement signal are superimposed. For example, if the measurement process is not conducted, a measurement signal is not generated by the measurement processing unit 420, and thus the audio signal output unit 440 causes the speaker 20 to output a music signal only. As another example, if the measurement process is conducted, the audio signal output unit 440 superimposes a measurement signal generated by the measurement processing unit 420 onto a music signal, and causes the speaker 20 to output the superimposed signal. As another example, as described in (4-1. Modification of measurement control signal) below, the audio signal output unit 440 may also cause the speaker 20 to output only a measurement signal at timings in which a music signal does not exist, such as in between two songs. In this way, at the timings when the measurement process is conducted, the audio signal output unit 440 causes the speaker 20 to output a measurement signal superimposed onto a music signal, or a measurement signal only. Note that when the speaker 20 is provided in plural, the audio signal output unit 440 is able to output a different audio signal to each channel corresponding to each speaker 20. For example, the audio signal output unit 440 may output a music signal with a measurement signal superimposed thereon to one channel, and output only a music signal to another channel.

Herein, in the first embodiment, an audio signal in an inaudible band (20 (kHz) or above, for example) is used as the measurement signal. Consequently, even if an audio signal obtained by superimposing a music signal and a measurement signal is output from the speaker 20, the user is nearly unable to perceive the measurement signal, and is able to enjoy purely the music signal which is the original target to be viewed.

The audio signal acquisition unit 450 acquires a pickup signal that has been output from the speaker 20 and picked up by the microphone 310 of the mobile terminal 30. The audio signal acquisition unit 450 is able to acquire the pickup signal from the microphone 310 of the mobile terminal 30 by wireless communication according to any of various methods using radio waves, for example. The audio signal acquisition unit 450 provides the acquired pickup signal to the measurement processing unit 420. In the measurement processing unit 420, the user's viewing position is computed based on the pickup signal. Note that the audio signal acquisition unit 450 may also adjust the gain appropriately and amplify the pickup signal to a suitable magnitude according to the level (volume level) of the pickup signal from the microphone 310. This amplification process may be conducted by an amp that may be installed in the microphone 310 when picking up the audio signal, or be conducted by the audio signal acquisition unit 450 after the pickup signal is acquired.

At this point, as discussed above, the audio signal output unit 440 causes the speaker 20 to output a measurement signal at the timings when the measurement process is conducted. Consequently, it is not necessary to drive the audio signal acquisition unit 450 continuously, and the audio signal acquisition unit 450 may be synchronized with the operation of the audio signal output unit 440 and acquire the pickup signal only while the audio signal output unit 440 is outputting a measurement signal.

The above thus describes an overall configuration of the viewing system 1 according to the first embodiment with reference to FIG. 1. Next, the functions of the measurement control unit 410, the measurement processing unit 420, and the sound field correction unit 430 which are the major components of the viewing system 1 will be described in detail.

(2-2. Measurement Processing Unit)

Figure 2:
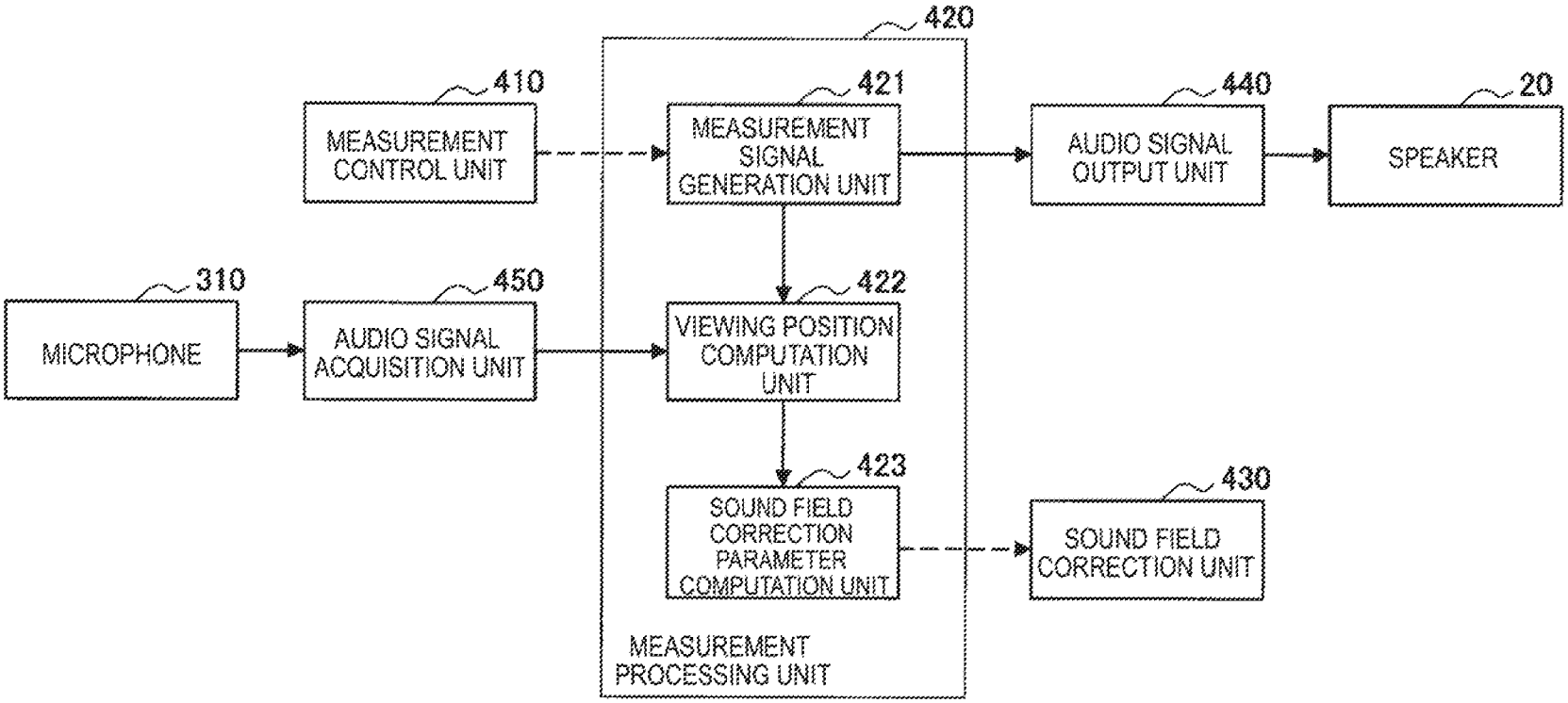
FIG. 2 is a block diagram illustrating an example of a functional configuration of a measurement processing unit.
Figure 3:
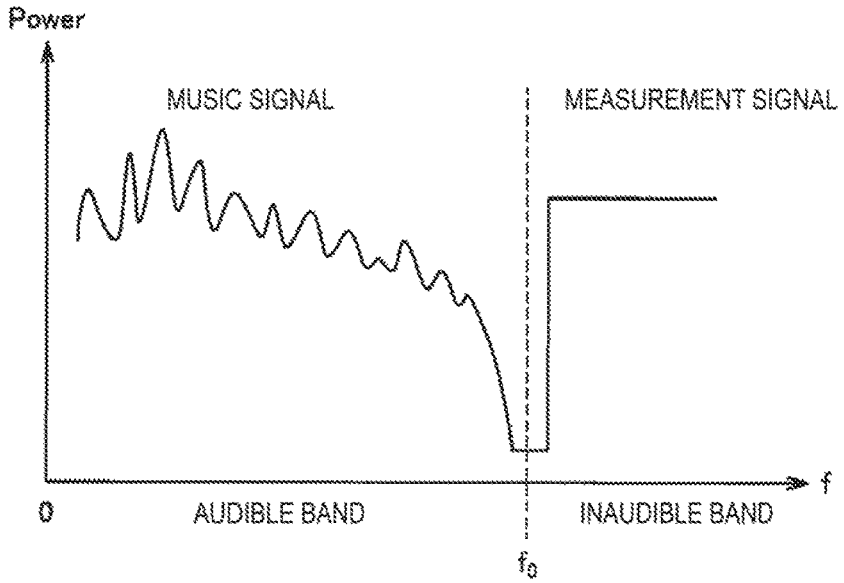
FIG. 3 is a diagram for explaining a relationship between a music signal and a measurement signal.
Figure 4:
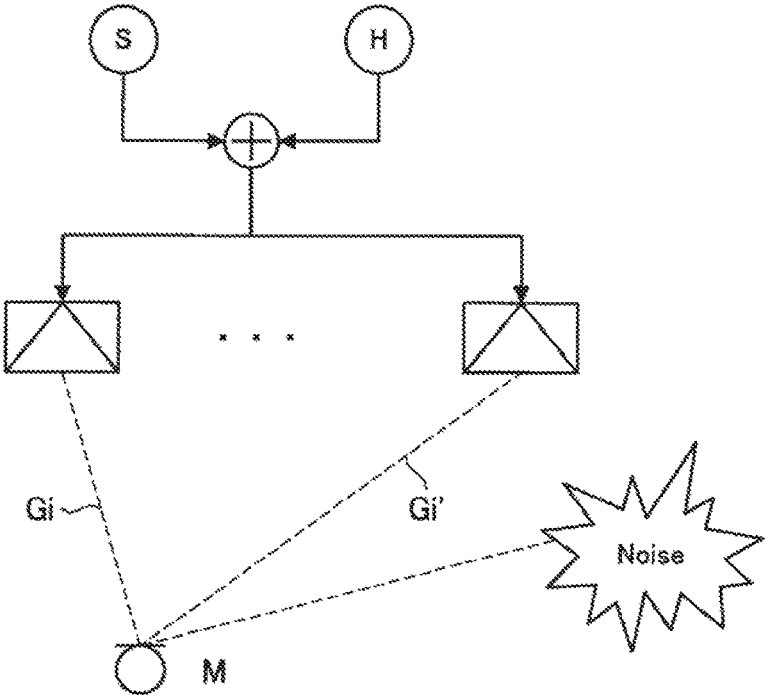
FIG. 4 is an explanatory diagram for explaining a viewing position measurement method.

The functions of the measurement processing unit 420 will be described with reference to FIGS. 2 to 4. FIG. 2 is a block diagram illustrating an example of a functional configuration of the measurement processing unit 420. FIG. 3 is a diagram for explaining a relationship between a music signal and a measurement signal. FIG. 4 is an explanatory diagram for explaining a viewing position measurement method.

Referring to FIG. 2, functionally, the measurement processing unit 420 includes a measurement signal generation unit 421, a viewing position computation unit 422, and a sound field correction parameter computation unit 423. Note that in FIG. 2, the functional components of the measurement processing unit 420 are illustrated jointly with selected components related to each function of the measurement processing unit 420 from among the components of the viewing system 1 illustrated in FIG. 1.

(Measurement Signal Generation Unit)

The measurement signal generation unit 421 generates a measurement signal according to the measurement control signal provided by the measurement control unit 410. For the measurement signal H(n), the signal expressed in Math. 1 below may be applied favorably, for example. Herein, T(n) is a time-stretched pulse (TSP) signal (see Math. 2 below), while W(n) represents bandpass filter characteristics (see Math. 3 below). In addition, A is the volume level of the measuring audio, $f_s$ is the sampling frequency, $f_0$ is the lowest frequency of the measurement signal (lower limit frequency), and N is the number of samples in the measurement signal. Note that since T(n) indicated in Math. 2 is widely known in the field of acoustic measurement as the "optimized Aoshima's time-stretched pulse (OATSP)", a detailed description is omitted herein.

[Math. 1]

$$H(n) = T(n)W(n) \tag{1}$$

[Math. 2]

$$T(n) = \begin{cases} A\exp\left(\frac{j4\pi mn^2}{N^2}\right) & 0 \le n \le \frac{N}{2} \\ T(N-n) & \frac{N}{2} < n < N \end{cases} \tag{2}$$

[Math. 3]

$$W(n) = \begin{cases} 1 & 0 \le n < n_0,\ N - n_0 \le n < N \\ 0 & n_0 \le n < N - n_0 \end{cases} \tag{3}$$

$$n_0 = \frac{f_0}{f_s}N$$

FIG. 3 schematically illustrates the frequency characteristics of the strength of a music signal and a measurement signal. In the first embodiment, the lower limit frequency $f_0$ may be set in an inaudible band (20 (kHz) and higher). Consequently, since the bandpass filter characteristics W(n) indicated in Math. 3 above have a characteristic of passing the audio signal in the inaudible band, the measurement signal may become a signal in the inaudible band. Thus, even if the measurement signal is superimposed onto a music signal in the audible band corresponding to music content, the auditory influence on the user is extremely small. For this reason, it becomes possible to execute the measurement process while the user is viewing music content, without interrupting viewing.

Note that the first embodiment presupposes that the characteristics of the system, including the speaker 20, that outputs the audio signal (hereinafter also called the audio output system) and the characteristics of the system, including the microphone 310, that picks up audio (hereinafter also called the pickup system) are known in advance. Consequently, the lower limit frequency $f_0$ (that is, the bandpass filter characteristics W(n)) may be set so that the frequency band of the measurement signal corresponds to the playback band of the speaker 20 and/or the pickup band of the microphone 310. Accordingly, a sufficient signal level (the S/N ratio, for example) may be ensured for the components corresponding to the measurement signal in the pickup signal, and the accuracy of the process of computing the viewing position in the viewing position computation unit 422 below may be improved.

The measurement signal generated by the measurement signal generation unit 421 is output from the speaker 20 via the audio signal output unit 440. Sound emitted from the speaker 20 propagates through the viewing space, and is picked up by the microphone 310. The pickup signal picked up by the microphone 310 is acquired by the audio signal acquisition unit 450, and input into the viewing position computation unit 422. Additionally, the measurement signal generation unit 421 also provides the generated measurement signal to the viewing position computation unit 422.

(Viewing Position Computation Unit)

The viewing position computation unit 422 computes the user's viewing position based on the pickup signal output from the speaker 20 and picked up by the microphone 310. Referring to FIG. 4, an example of a method of computing the user's viewing position which may be executed by the viewing position computation unit 422 will be described.

FIG. 4 illustrates, as an example, a case in which measurement signals output from multiple speakers 20 are picked up by one microphone 310.

The sound Y(n) picked up by the microphone 310 includes a music signal, a measurement signal superimposed onto the music signal, and noise such as ambient sounds. At this point, provided that $G_{ij}$ is the transfer function from the ith speaker 20 to the jth microphone 310, when a measurement signal is superimposed onto the music signal output by the i'th speaker 20, the pickup signal $Y_{i'j}(n)$ correspond to the sound picked up by the jth microphone 310 is expressed according to Math. 4 below. Herein, "M" is a parameter expressing the characteristics of the microphone 310, while "$S_i$" is a parameter expressing the characteristics of the music signal output from the ith speaker 20. Also, "$\text{Noise}_j$" represents the noise component, such as ambient sounds, picked up by the jth microphone 310.

[Math. 4]

$$Y_{i'j}(n) = M\left\{\sum_i s_i G_{ij} + HG_{i'j} + \text{Noise}_j\right\} \tag{4}$$

At this point, ordinarily, since the noise and the music signals are unsteady, by acquiring the pickup signal multiple times and performing synchronous averaging on the results, their influence may be reduced. In other words, the relationship indicated in Math. 5 below may be established. However, in this case, it is assumed that the transfer function $G_{ij}$ is invariable during measurement.

[Math. 5]

$$\overline{S_i}G_{ij},\ \overline{\text{Noise}_j} << \overline{HG_{i'j}} \tag{5}$$

Also, by applying the bandpass filter characteristics W(n) to the pickup signal $Y_{i'j}(n)$ instead of the above synchronous averaging or in addition to synchronous averaging, it is possible to remove signals in frequency bands other than the band corresponding to the measurement signal. Consequently, by performing synchronous averaging and/or applying the bandpass filter characteristics W(n) to the pickup signal $Y_{i'j}(n)$, the viewing position computation unit 422 is able to extract the component corresponding to the measurement signal from out of the pickup signal $Y_{i'j}(n)$. For example, in the case of performing synchronous averaging and also applying the bandpass filter characteristics W(n), the component corresponding to the measurement signal from out of the pickup signal $Y_{i'j}(n)$ may be expressed as in Math. 6 below.

[Math. 6]

$$W(n)\overline{Y_{i'j}(n)} = M\left\{\sum_i \overline{S_i}G_{ij} + W(n)HG_{i'j} + \overline{\text{Noise}_j}\right\} \cong W(n)MHG_{i'j} \tag{6}$$

Note that although Math. 6 above indicates a case of performing synchronous averaging and also applying the bandpass filter characteristics W(n) to the pickup signal $Y_{i'j}(n)$, the component corresponding to the measurement signal may also be extracted by performing only one of the above.

Herein, as discussed earlier, since the first embodiment presupposes that the characteristics of the pickup system are already known, the characteristics M of the microphone 310 may be known in advance as a design value. Consequently, the inverse characteristics $M^{-1}$ of the microphone 310 may also be acquired in advance as a known parameter. Additionally, as indicated in Math. 1 above, since the measurement signal H(n) is also a known function that may be set by a person such as the designer of the viewing system 1, the inverse characteristics $H^{-1}$ in the band at or above the frequency $f_0$ may also be a known parameter. Consequently, by applying the inverse characteristics $M^{-1}$ of the microphone 310 and the inverse characteristics $H^{-1}$ in the band at or above the frequency f0 of the measurement signal H(n) to the result obtained from Math. 6 above, the viewing position computation unit 422 is able to compute the transfer function $G_{i'j}$ in the band at or above the frequency $f_0$, like in Math. 7 below.

[Math. 7]

$$W(n)\overline{Y_{ij}(n)}M^{-1}H^{-1} \cong W(n)G_{i'j} \tag{7}$$

If Math. 7 above is expressed in component form, the component $g_{i'j}$ of the transfer function $G_{i'j}$ may be expressed like in Math. 8 below.

[Math. 8]

$$w(n)*\overline{y_{ij}(n)}*m^{-1}*h^{-1} \cong w(n)*g_{i'j} \tag{8}$$

Note that in the above, Math. 7 and Math. 8 are derived using a function and a signal in the frequency domain, but it is also possible to derive a transfer function similarly using a function and a signal in the time domain. Additionally, if the characteristics M of the microphone 310 are unknown, as long as the characteristics M do not have a large timewise delay, the signal indicated in Math. 7 and Math. 8 above may also be derived without convolving the inverse characteristics of the microphone 310. This is because if the characteristics M of the microphone 310 do not have a large timewise delay, the characteristics M of the microphone 310 may be considered to exert little influence on the time until the measuring audio arrives from the speaker 20 to the microphone 310 (the arrival time $\Delta T_{i'j}$ discussed later).

Meanwhile, in an ordinary viewing environment, it is extremely rare for the reflected sound (or the sound arriving at the microphone 310 second or later) to have a greater volume level than the direct sound (or the sound arriving at the microphone 310 first). Consequently, the time at which $w(n)*g_{i'j}$ gives the maximum amplitude may be considered to be the arrival time of the direct sound at the microphone 310. In addition, provided that "SystemDelay" is the sum of the time from the measurement signal being output from the measurement signal generation unit 421 until the measurement signal is output from the speaker 20, and the delay time from the measurement signal arriving at the microphone 310 until being input into the viewing position computation unit 422, the specific value of this "SystemDelay" may be known in advance as a design value. Consequently, the viewing position computation unit 422 is able to use Math. 9 below to calculate the time $\Delta T_{i'j}$ from the measurement signal being output from the speaker 20 until direct sound arrives at the microphone 310 (the arrival time $\Delta T_{i'j}$).

[Math. 9]

$$\Delta T_{i'j} = arg\{\max(w(n)*g_{i'j})\} - \text{SystemDelay} \tag{9}$$

Consequently, the viewing position computation unit 422 is able to use the speed of sound c in Math. 10 below to compute the distance $l_{i'j}$ between the speaker 20 that output the measurement signal and the microphone 310.

[Math 10]

$$l_{i'j} = c\Delta T_{i'j} \tag{10}$$

If multiple speakers 20 exist and the distance between these speakers 20 is known, or if multiple microphones 310 exist and the distance between these microphones 310 is known, the relative position of the speaker 20 and the microphone 310 may be computed by using trigonometry, for example. For example, if multiple speakers 20 exist, a measurement signal may be output successively from each of the multiple speakers 20, and the series of calculations described above may be performed successively on the pickup signals picked up by the microphone 310 to thereby compute the distance $l_{i'j}$ from each speaker 20 to the microphone 310. These computed distances $l_{i'j}$ then may be used to compute the relative distances between the speakers 20 and the microphone 310.

In the first embodiment, it is supposed that the mobile terminal 30 is being held by the user or placed a close distance from the user, and thus the position of the microphone 310 may be considered to indicate the user's viewing position. By performing the series of calculations described above on a pickup signal output from the speaker 20 and picked up by the microphone 310, The viewing position computation unit 422 is able to compute the user's viewing position in the viewing environment. The viewing position computation unit 422 provides information about the computed user's viewing position to the sound field correction parameter computation unit 423. Note that the information about the user's viewing position may include information about the relative position of the user (or the microphone 310) with respect to the speaker 20, information about the distance $l_{i'j}$ from the speaker 20 to the user (or the microphone 310), and/or information about the arrival time $\Delta T_{i'j}$ of the measurement signal from the speaker 20 to the user (or the microphone 310).

(Sound Field Correction Parameter Computation Unit)

The sound field correction parameter computation unit 423 computes a sound field correction parameter for correcting the music signal, based on the information about the user's viewing position provided by the viewing position computation unit 422. For example, the sound field correction parameter computation unit 423 may compute a delay amount for each channel, gain, frequency characteristics, virtual surround coefficients, or the like as the sound field correction parameter.

For example, the sound field correction parameter computation unit 423 may use the arrival time $\Delta T_{i'j}$ in Math. 11 below to compute the delay amount $dly_i$ for the ith channel. Herein, j' is an index indicating the microphone 310 selected by someone such as the designer of the viewing system 1 or the user.

[Math. 11]

$$dly_i = \max_k(\Delta T_{kj'}) - \Delta T_{ij'} \tag{11}$$

In addition, as the distance between the speaker 20 and the user becomes greater, it is conceivable that the volume of the music signal perceived by the user will fall proportionally. Consequently, for example, the sound field correction parameter computation unit 423 may use the distance $l_{ij}$ in Math. 12 below to compute the volume gain $gain_i$ for the each channel. Herein, C is a constant.

[Math. 12]

$$gain_i = Cl_{ij}, \quad (12)$$

Note that the sound field correction parameters indicated in Math. 11 and Math. 12 above are examples of the sound field correction parameter that may be computed in the first embodiment, and the sound field correction parameter computation unit 423 may also compute various other types of sound field correction parameters based on the user's viewing position. Additionally, the specific methods of computing the delay amount $dly_i$ and the volume gain $gain_i$ are not limited to the examples indicated in Math. 11 and Math. 12 above, and these sound field correction parameters may also be computed by other methods.

The sound field correction parameter computation unit 423 provides the computed sound field correction parameter to the sound field correction unit 430. At this point, the sound field correction parameter computation unit 423 may provide the sound field correction parameter to the sound field correction unit 430 and update the currently set sound field correction parameter only if the sound field correction parameter currently set in the sound field correction unit 430 (that is, the sound field correction parameter computed by the sound field correction parameter computation unit 423 in the previous measurement process) and the sound field correction parameter computed in the current measurement process have changed sufficiently. For example, the sound field correction parameter computation unit 423 may update the sound field correction parameter if the difference between the sound field correction parameter from the previous measurement process and the sound field correction parameter from the current measurement process is greater than a certain threshold value. Alternatively, the sound field correction parameter computation unit 423 may determine whether or not to update the sound field correction parameter based on the amount of change in the user's viewing position computed by the viewing position computation unit 422. For example, the sound field correction parameter computation unit 423 may update the sound field correction parameter if the user's viewing position has changed sufficiently. If the sound field correction parameter is changed too frequently, the music signal may become unsteady, and there is a possibility of producing the opposite effect of impairing the sound quality and making the user feel uncomfortable. Consequently, in this way, by not updating the sound field correction parameter if the change in the sound field correction parameter and/or the user's viewing position is small, it becomes possible to provide music content to the user more consistently.

Herein, in this specification, to describe the magnitude relationships between various physical quantities (such as the above sound field correction parameter, for example) and threshold values, phrases such as "less than or equal to" and "equal to or greater than" are used, but these phrases are merely for the sake of example, and do not limit the boundary conditions when comparing physical quantities to their threshold values. In the first embodiment, and in the second embodiment discussed later, the boundary conditions when comparing various physical quantities to their threshold values may also be set arbitrarily. In this specification, the phrase "less than or equal to" may also be used interchangeably with the phrase "less than", and the phrase "equal to or greater than" may also be used interchangeably with the phrase "greater than".

The above thus describes the functions of the measurement processing unit 420 with reference to FIGS. 2 to 4. As described above, according to the present embodiment, measuring audio in an inaudible band is used to measure the user's viewing position. Even if the measuring audio in the inaudible band is superimposed onto a music signal, the measuring audio barely affects the user's viewing, thereby making it possible to measure the viewing position while the user is viewing music content, without the user noticing. Consequently, it is possible to measure the user's viewing position without reducing user convenience.

(2-3. Sound Field Correction Unit)

Figure 5:
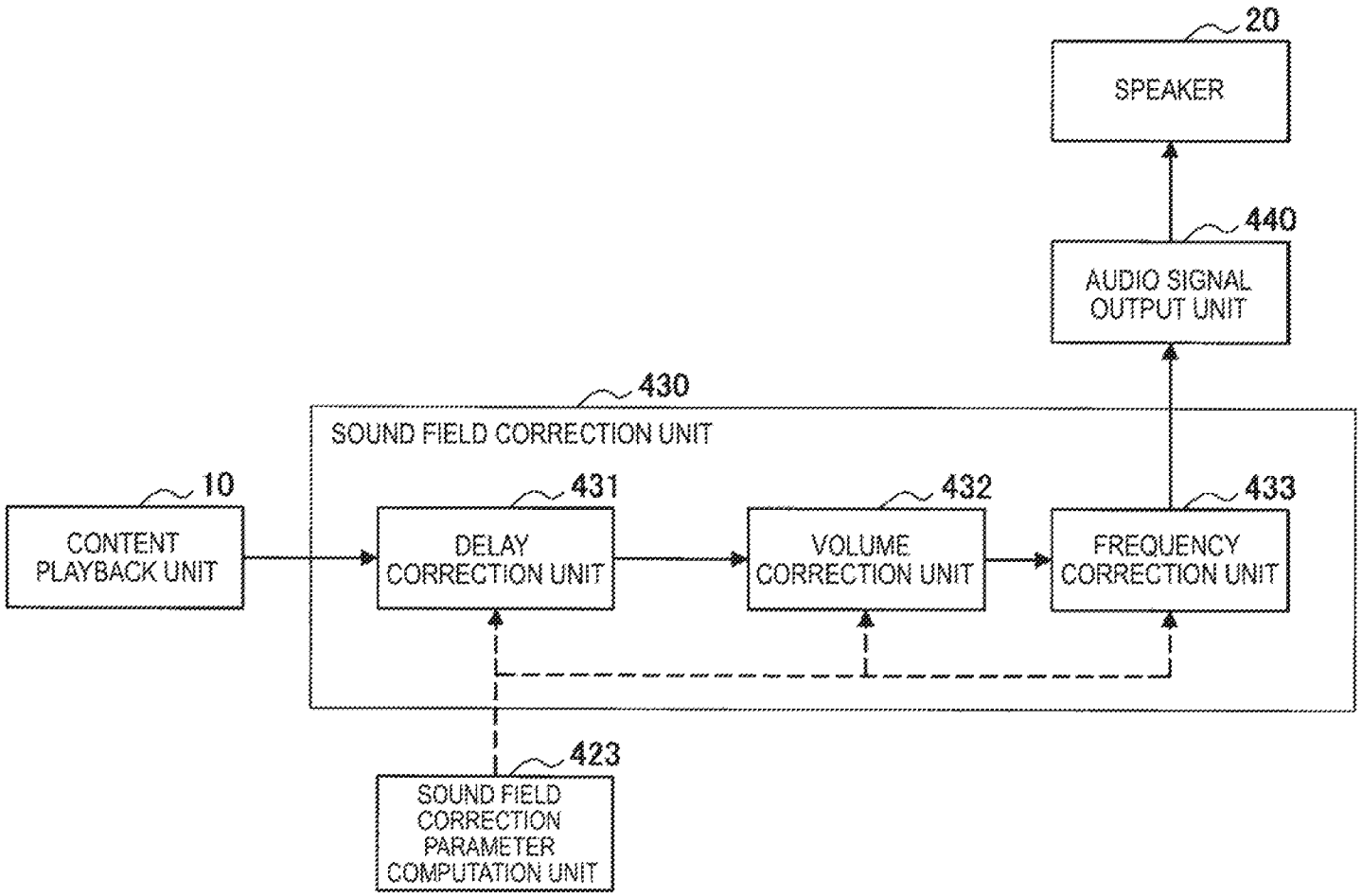
FIG. 5 is a block diagram illustrating an example of a functional configuration of a sound field correction unit.
Figure 6:
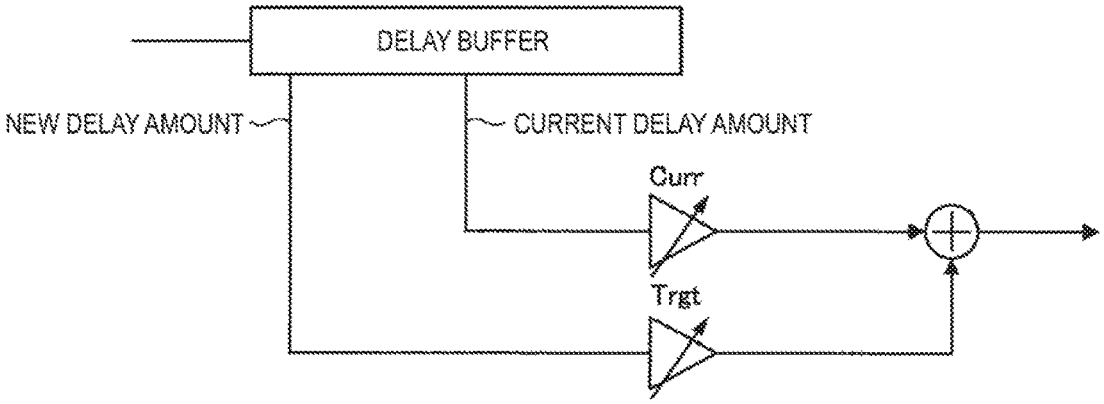
FIG. 6 is an explanatory diagram for explaining a correction of a delay amount based on a sound field correction parameter.
Figure 7:
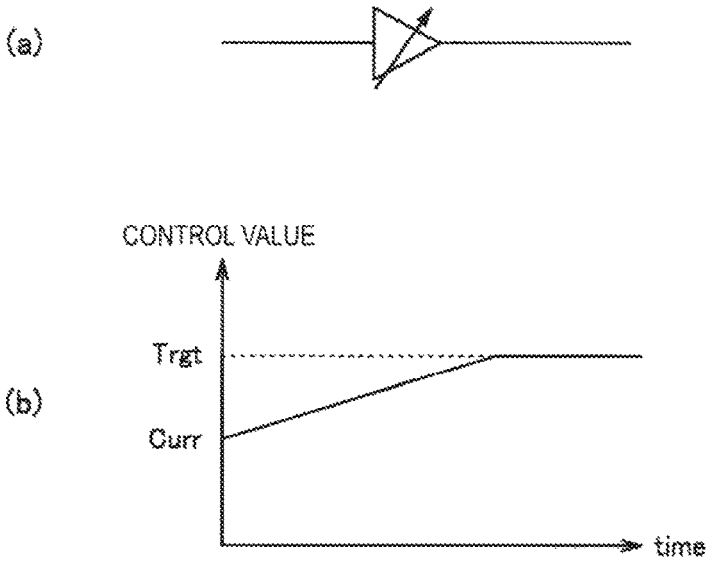
FIG. 7 is an explanatory diagram for explaining a correction of volume gain based on a sound field correction parameter.
Figure 8:
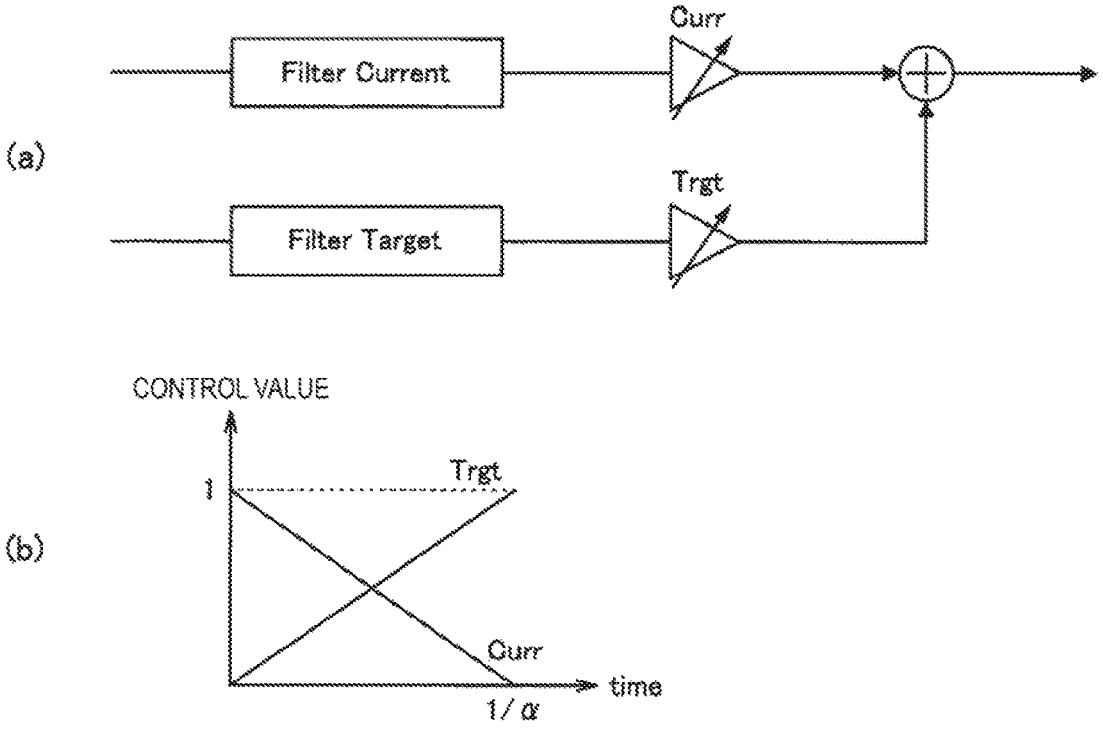
FIG. 8 is an explanatory diagram for explaining a correction of frequency characteristics based on a sound field correction parameter.

The functions of the sound field correction unit 430 will be described with reference to FIGS. 5 to 8. FIG. 5 is a block diagram illustrating an example of a functional configuration of the sound field correction unit 430. FIG. 6 is an explanatory diagram for explaining a correction of a delay amount based on a sound field correction parameter. FIG. 7 is an explanatory diagram for explaining a correction of volume gain based on a sound field correction parameter. FIG. 8 is an explanatory diagram for explaining a correction of frequency characteristics based on a sound field correction parameter.

The sound field correction unit 430 corrects the sound field of the viewing environment by applying various corrections to the music signal based on a sound field correction parameter computed by the sound field correction parameter computation unit 423. The sound field corrections may be, for example, corrections such as a delay amount correction (time alignment), volume balance correction, and/or correction of frequency characteristics (such as a head-related transfer function or speaker directionality characteristics, for example). The sound field correction parameter computed by the sound field correction parameter computation unit 423 may be a value (Trgt) that serves as a target of a control value for the delay amount, the volume balance, or the frequency characteristics. In the correction process conducted by the sound field correction unit 430, the control values related to these characteristics are changed from the current control value (Curr) to the new control value (Trgt) to serve as the target based on the sound field correction parameter.

At this point, if these control values are changed suddenly, the waveform of the music signal may become discontinuous, and there is a possibility that the user may perceive the discontinuity as noise. Consequently, in the first embodiment, these control values are changed so as to proceed smoothly from the current control value (Curr) to the new control value (Trgt) based on the sound field correction parameter.

FIG. 5 illustrates an example of a functional configuration of the sound field correction unit 430. Referring to FIG. 5, functionally, the sound field correction unit 430 includes a delay correction unit 431, a volume correction unit 432, and a frequency correction unit 433. Note that in FIG. 5, the functional components of the sound field correction unit 430 are illustrated jointly with selected components related to each function of the sound field correction unit 430 from among the components of the viewing system 1 illustrated in FIG. 1.

The delay correction unit 431 corrects a delay amount in the music signal based on the sound field correction parameter. FIG. 6 schematically illustrates one example of a circuit that may constitute the delay correction unit 431. As illustrated in FIG. 6, in the delay correction unit 431 may be configured so that a variable-gain amplifier is provided for each of a music signal which is delayed based on the current delay amount (Curr) by a delay buffer and a music signal which is delayed based on the new delay amount (Trgt) by the delay buffer, and also so that the music signal which is delayed based on the current delay amount (Curr) and amplified or attenuated by a certain factor, and the music signal which is delayed based on the new delay amount (Trgt) and amplified or attenuated by a certain factor, are added together by an adder circuit. In the delay correction unit 431, by appropriately adjusting the control values of the variable-gain amplifiers, it becomes possible to mix the music signal delayed based on the current delay amount (Curr) and the music signal delayed based on the new delay amount (Trgt) at a certain mixing ratio. For example, the delay correction unit 431 causes the delay amount in the music signal to transition gradually from the current delay amount (Curr) to the new delay amount (Trgt) while gradually changing the mixing ratio between the music signal delayed based on the current delay amount (Curr) and the music signal delayed based on the new delay amount (Trgt).

The volume correction unit 432 corrects volume gain in the music signal based on the sound field correction parameter. FIG. 7(*a*) schematically illustrates one example of a circuit that may constitute the volume correction unit 432. As illustrated in FIG. 7(*a*), the volume correction unit 432 may be made up of a variable-gain amplifier, for example. Also, FIG. 7(*b*) schematically illustrates one example of a method of changing a control value for variable gain which may be performed in the volume correction unit 432. As illustrated in FIG. 7(*b*), in the volume correction unit 432, the set value of the variable-gain amplifier is changed so that the gain transitions gradually from the current gain (Curr) to the new gain (Trgt). Consequently, the gain of the music signal transitions gradually to the new gain (Trgt).

The frequency correction unit 433 corrects frequency characteristics in the music signal (such as a head-related transfer function or the directionality characteristics of the speaker 20, for example) based on the sound field correction parameter. FIG. 8(*a*) schematically illustrates one example of a circuit that may constitute the frequency correction unit 433. As illustrated in FIG. 8(*a*), the frequency correction unit 433 may be configured so that a variable-gain amplifier is provided for each of a music signal passing through a filter (Filter Current) that performs a filter process based on the current frequency characteristics (Curr) and a music signal passing through a filter (Filter Target) that performs a filter process based on the new frequency characteristics (Trgt), and also so that the music signal which is filtered based on the current frequency characteristics (Curr) and amplified or attenuated by a certain factor, and the music signal which is filtered based on the new frequency characteristics (Trgt) and amplified or attenuated by a certain factor, are added together by an adder circuit. Also, FIG. 8(*b*) schematically illustrates one example of a method of changing a control value for a variable-gain amplifier which may be performed in the frequency correction unit 433. In the frequency correction unit 433, by appropriately adjusting the control values of the variable-gain amplifiers, it becomes possible to mix the music signal filtered based on the current frequency characteristics (Curr) and the music signal filtered based on the new frequency characteristics (Trgt) at a certain mixing ratio. As illustrated in FIG. 8(*b*), in the frequency correction unit 433, the set values of the variable-gain amplifiers are changed so that the ratio of the music signal filtered based on the current frequency characteristics (Curr) lowers gradually, while the ratio of the music signal filtered based on the new frequency characteristics (Trgt) rises gradually. Consequently, the frequency characteristics of the music signal transition gradually to the new frequency characteristics (Trgt).

The above thus describes the functions of the sound field correction unit 430 with reference to FIGS. 5 to 8. As described above, according to the first embodiment, the music signal is corrected based on the user's viewing position measured using measuring audio in an inaudible band. The music signal corrected by the sound field correction unit 430 is output from the speaker 20 via the audio signal output unit 440. Consequently, a more suitable sound field corresponding to the user's viewing position is formed, and thus the sense of presence is increased for the user, and the playback of music content with superior sound quality is realized.

Note that the sound field correction unit 430 may perform all of the delay amount correction, the gain correction, and the frequency characteristics correction described above, or perform some of these corrections. For example, the sound field correction unit 430 may conduct the process of gradually changing the sound field correction parameter as described above only on a sound field correction parameter updated by the sound field correction parameter computation unit 423, and maintain the correction of the music signal using the current sound field correction parameter for other characteristics. Additionally, the sound field correction unit 430 may also correct the music signal for characteristics other than the delay amount correction, the gain correction, and the frequency characteristics correction described above. For example, if the viewing system 1 includes what is called a surround 3D function, and is configured to be able to provide audio to the user in three dimensions using multiple speakers 20, the sound field correction unit 430 may correct the music signal as appropriate so that this surround 3D function may function more suitably according to the user's viewing position.

(2-4. Measurement Control Unit)

The functions of the measurement control unit 410 will be described. The measurement control unit 410 determines whether or not to start the process of measuring the user's viewing position, based on a certain condition, and in the case of starting the measurement process, provides a measurement control signal to the measurement processing unit 420. Additionally, the measurement control unit 410 is able to provide various types of parameters used when the measurement processing unit 420 conducts the measurement process (such as "S" expressing the characteristics of the music signal and "M" expressing the characteristics of the microphone 310 discussed earlier) together with the measurement control signal to the measurement processing unit 420.

For example, the measurement control unit 410 is able to output a measurement control signal to keep measuring the user's viewing position continuously, or to measure the user's viewing position periodically at certain timings. However, if the user's viewing position does not change greatly, there is a possibility that the sound field correction parameter also does not change greatly, and thus the necessity of re-measuring the user's viewing position is considered to be low. Also, if the measurement signal is picked up by the microphone 310 of the mobile terminal 30 like in the first embodiment, it is desirable that the measurement process is conducted at timings when the user is reliably inferred to be near the mobile terminal 30. Accordingly, the measurement control unit 410 may also output the measurement control signal based on information indicating the movement state of the mobile terminal 30.

For example, the measurement control unit 410 is able to output a measurement control signal when the movement state of the mobile terminal 30 changes greatly, based on various information indicating the movement state of the mobile terminal 30 transmitted from the sensor 330 of the mobile terminal 30, such as information about motion, orientation, and position, for example. This is because if the position and orientation of the mobile terminal 30 are changing greatly, it is inferred that the user is moving while holding the mobile terminal 30 in hand, and thus the likelihood that the user's viewing position will change is considered to be high. For example, if an output value from the sensor 330 exceeds a certain threshold value, the measurement control unit 410 may determine that the movement state of the mobile terminal 30 has changed greatly, and output a measurement control signal.

Figure 9:
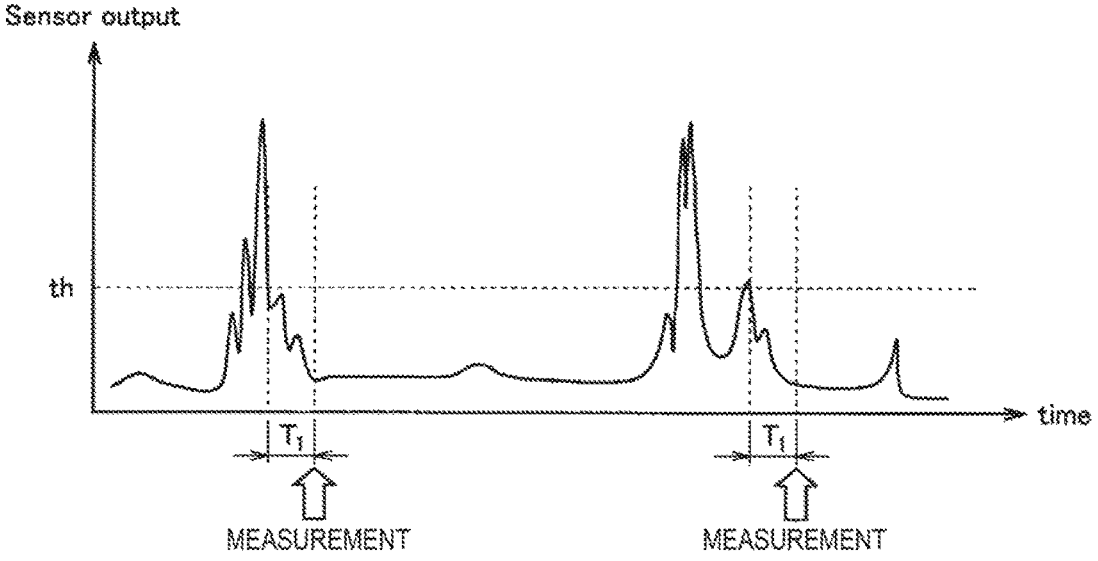
FIG. 9 is an explanatory diagram for explaining an example of timings at which a measurement control unit outputs a measurement control signal.

However, if measurement is conducted while the mobile terminal 30 is moving or while its orientation is changing, noise due to the change in the movement state of the mobile terminal 30 may be produced, and there is a possibility that the accuracy of the measurement process may be reduced. Consequently, the measurement control signal may also be output after a certain time elapses from detecting a change in the movement state of the mobile terminal 30. FIG. 9 is an explanatory diagram for explaining an example of such timings at which the measurement control unit 410 outputs a measurement control signal. For example, as illustrated in FIG. 9, the measurement control unit 410 may output a measurement control signal at a timing after a certain time T1 elapses from when the output from the sensor 330 of the mobile terminal 30 exceeds a certain threshold value (th) and falls below th once again.

As another example, the measurement control unit 410 is able to output a measurement control signal based on information indicating operating input performed on the mobile terminal 30 by the user and transmitted from the operating unit 320 of the mobile terminal 30. This is because if operating input is performed on the mobile terminal 30, it is inferred that the user is present near the mobile terminal 30.

Furthermore, the measurement control unit 410 may also output a measurement control signal based on information about the playback status of music content transmitted from the content playback unit 10. For example, the measurement control unit 410 is able to output a measurement control signal if the playback state in the content playback unit 10 changes (in other words, if a certain even (such as play, pause, fast forward, or rewind, for example) occurs in the content playback unit 10). If the playback state in the content playback unit 10 changes, it is inferred that the user is actively viewing (or attempting to view) music content and is present in the viewing environment. Thus, the measurement process may be conducted, and the correction of the music signal according to the user's viewing position may be executed.

The above thus describes the functions of the measurement control unit 410. As described above, according to the first embodiment, when it is inferred that the user is near the mobile terminal 30, when the user moves and changes viewing position, or when the user has expressed an intent to actively view music content, for example, a measurement process signal is output appropriately, and the measurement process is executed. Consequently, the measurement of the user's viewing position and the correction of the music signal based on the viewing position are conducted at more appropriate timings, and user convenience may be improved further.

The above thus describes a configuration of the viewing system 1 according to the first embodiment. As described above, according to the first embodiment, a measurement signal in an inaudible band is used to measure the user's viewing position. Even if the measurement signal in an inaudible band is superimposed onto an ordinary music signal in an audible band, the user barely notices the measurement signal, thereby making it possible to measure the viewing position even while the user is in the middle of viewing music content, without the user noticing. Thus, an appropriate sound field matched to the user's viewing position may be realized without interrupting the user's viewing of the music content. Additionally, even if the user's viewing position changes, the user's movement is tracked automatically, and the user's viewing position is measured again. Consequently, continuous playback of a suitable sound field becomes possible.

Note that although the above describes a case in which the content played back on the viewing system 1 is music content, the first embodiment is not limited to such an example. For example, in the viewing system 1, video content may also be played back. In the case of playing back video content in the viewing system 1, the playback of local video content or the presentation of local visual information may be executed according to the measured viewing position of the user, for example.

Additionally, in the first embodiment, the measurement process and the process of correcting the sound field based on the result of the measurement process may be conducted by using a configuration such as the speaker 20 and an AV amp (in other words, the acoustic control device 40) which may be provided originally in the viewing system 1, and a smartphone (in other words, the mobile terminal 30) that the user may use from day to day. In this way, by not providing an additional hardware configuration, the measurement process and the sound field correction process may be realized at lower cost.

Additionally, although the above describes a case in which the microphone 310 that picks up a measurement signal in the viewing system 1 is provided on the mobile terminal 30, the first embodiment is not limited to such an example. For example, a microphone for the measurement process may be provided separately, and this microphone may be attached to the user's body. By measuring the user's viewing position based on a pickup signal from a microphone attached to the user's body, it becomes possible to measure the user's viewing position more reliably. Note that, preferably, this microphone is attached near the user's ears. By attaching the microphone near the user's ears, the position of the user's ears may be measured with high accuracy, thereby making it possible to conduct more accurate sound field correction according to the position of the user's ears which actually listen to the music signal.

(2-5. Information Processing Method)

Figure 10:
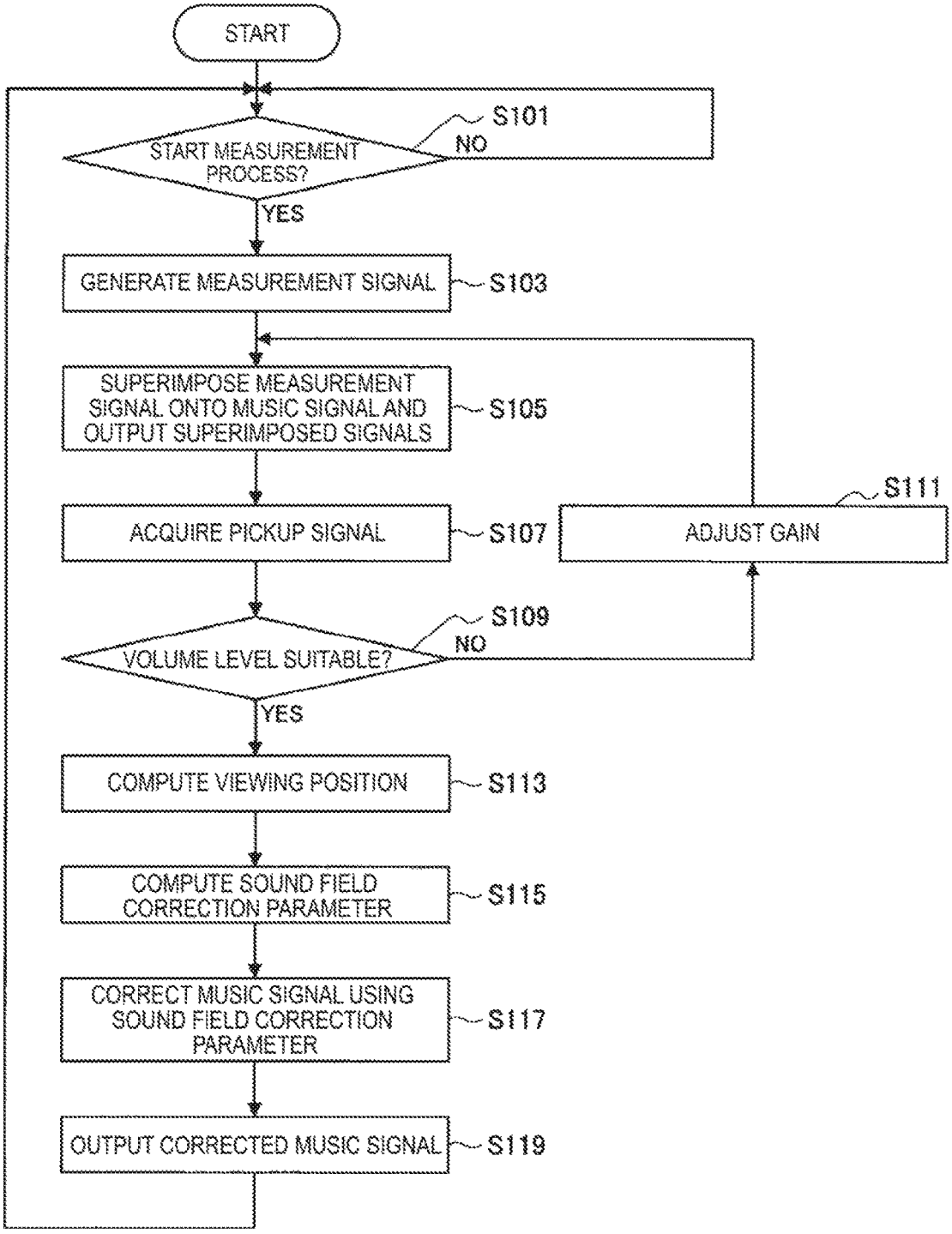
FIG. 10 is a flowchart illustrating an example of a processing procedure of an information processing method according to a first embodiment.

A processing procedure of an information processing method which may be executed in the viewing system 1 according to the first embodiment described above will be described with reference to FIG. 10. FIG. 10 is a flowchart illustrating an example of a processing procedure of an information processing method according to the first embodiment.

Referring to FIG. 10, in the information processing method according to the first embodiment, first, it is determined whether or not to start the measurement process, based on a certain condition (step S101). The process indicated in step S101 corresponds to the process executed by the measurement control unit 410 illustrated in FIG. 1 discussed earlier, for example. In step S101, the determination of whether or not to start the measurement process is made based on information operating input performed on the mobile terminal 30 by the user, information indicating the movement state of the mobile terminal 30, and/or information about the playback status of music content in the content playback unit 10, for example. In step S101, in the case of determining not to start the measurement process, the measurement process is not executed, and the determination process indicated in step S101 is repeated at a certain timing.

On the other hand, in step S101, in the case of determining to start the measurement process, a measurement control signal is output from the measurement control unit 410 to the measurement processing unit 420, and the flow proceeds to step S103. In step S103, a measurement signal is generated. The process indicated in step S103 corresponds to the process executed by the measurement signal generation unit 421 of the measurement processing unit 420 illustrated in FIG. 2 discussed earlier, for example.

Next, the generated measurement signal is superimposed onto the music signal of the music content being played back by the content playback unit 10, and is output from the speaker 20 (step S105). The process indicated in step S105 corresponds to the process executed by the audio signal output unit 440 illustrated in FIG. 1 discussed earlier, for example.

Next, a pickup signal corresponding to the music signal superimposed with the measurement signal output from the speaker 20 and picked up by the microphone 310 of the mobile terminal 30 is acquired (step S107). Subsequently, it is determined whether or not the volume level of the pickup signal is suitable (step S109). In the case of determining that the level of the pickup signal is not suitable, the gain is adjusted to a suitable value (step S111), the flow returns to step S105, the measurement signal is output, and the pickup signal is acquired again. On the other hand, in the case of determining that the level of the pickup signal is suitable, the flow proceeds to step S113. Note that the process indicating from steps S107 to S111 corresponds to the process executed by the audio signal acquisition unit 450 illustrated in FIG. 1 discussed earlier, for example.

In step S113, the user's viewing position is computed based on the acquired pickup signal. The process indicated in step S113 corresponds to the process executed by the viewing position computation unit 422 of the measurement processing unit 420 illustrated in FIG. 2 discussed earlier, for example. In step S113, the user's viewing position may be computed by performing a series of calculation processes as indicated from Math. 6 to Math. 10 above, for example.

Next, a sound field correction parameter is computed based on the computed user's viewing position (step S115). The process indicated in step S115 corresponds to the process executed by the sound field correction parameter computation unit 423 of the measurement processing unit 420 illustrated in FIG. 2 discussed earlier, for example. In step S115, a sound field correction parameter for correcting characteristics such as the delay amount, the volume balance, and/or the frequency characteristics of the music signal may be computed, for example.

Next, the music signal is corrected based on the computed sound field correction parameter (step S117). The process indicated in step S117 corresponds to the process executed by the sound field correction unit 430 illustrated in FIGS. 1 and 5 discussed earlier, for example. In step S117, the music signal may be corrected so that characteristics such as the delay amount, the volume balance, and/or the frequency characteristics of the music signal gradually transition from a current control value (Curr) to a control value (Trgt) that serves as a target computed in step S115.

Subsequently, the corrected music signal is output from the speaker 20 (step S119). The process indicated in step S119 corresponds to the process executed by the audio signal output unit 440 illustrated in FIG. 1 discussed earlier, for example. According to the above, a music signal corrected according to the user's viewing position is output from the speaker 20 to the user, and a more suitable sound field accounting for the user's viewing position is realized.

The above thus describes an information processing method according to the first embodiment.

(3. Second Embodiment)

Next, a second embodiment of the present disclosure will be described. In the first embodiment described above, the viewing position is measured under the presupposition that the characteristics of the system, including the speaker 20, that outputs the audio signal (that is, the audio output system) and the characteristics of the system, including the microphone 310, that picks up audio (that is, the pickup system) are known in advance.

At this point, consider a case in which at least one of the characteristics of the audio output system and the pickup system is unknown. In this case, there is a possibility that the frequency band of the measurement signal, the playback band of the speaker 20, and/or the pickup band of the microphone 310 may not correspond with each other, the signal level (the S/N ratio, for example) of the picked-up measurement signal (in other words, the pickup signal) may become lower, and adequate measurement accuracy may not be obtained.

Figure 11:
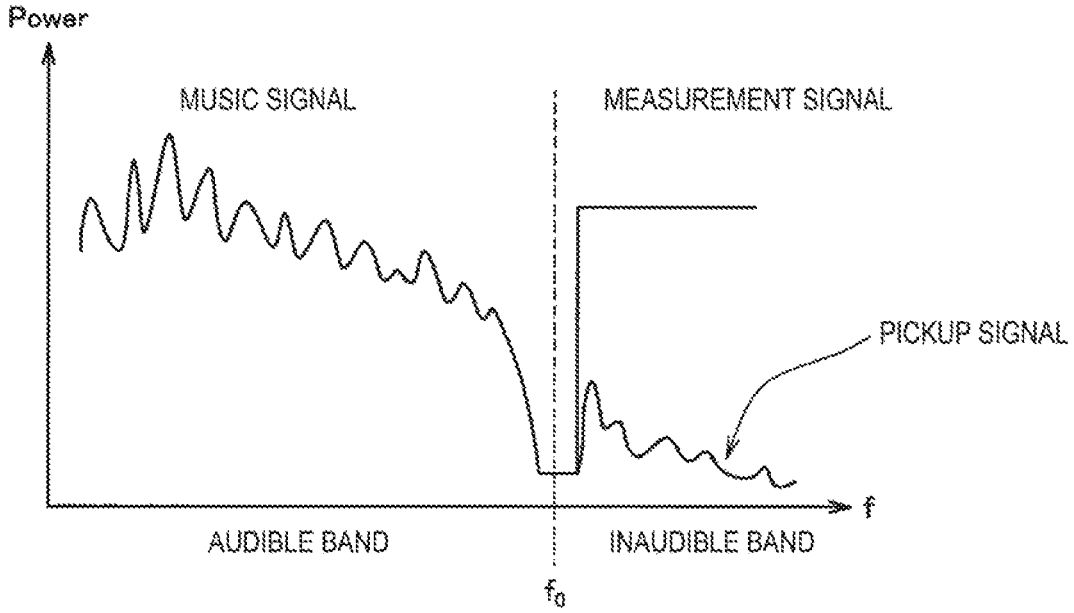
FIG. 11 is a diagram for explaining a relationship between a music signal, a measurement signal, and a pickup signal.

FIG. 11 schematically illustrates the frequency characteristics of a music signal, a measurement signal, and a pickup signal in a case in which the signal level of the pickup signal is low. FIG. 11 is a diagram for explaining the relationship between the music signal, the measurement signal, and the pickup signal. As illustrated in FIG. 11, similarly to the first embodiment, in the second embodiment, the music signal is an audio signal in an audible band, and the measurement signal may be set as an audio signal in an inaudible band having a frequency band greater than a lower limit frequency $f_0$. In the first embodiment, since the characteristics of the audio output system and the pickup system are known, it is possible to set the lower limit frequency $f_0$ appropriately so that the measurement signal becomes an audio signal in an inaudible band, and also so that the playback band of the speaker 20 and the pickup band of the microphone 310 correspond to each other. However, in the second embodiment, since at least one of the characteristics of the audio output system and the pickup system is unknown, it is difficult to set the lower limit frequency $f_0$ appropriately so that the frequency band of the measurement signal corresponds to the playback band of the speaker 20 and the pickup band of the microphone 310. Consequently, in the second embodiment, as illustrated in FIG. 11, there is a risk that the strength of the component in the inaudible band included in the pickup signal (in other words, the component corresponding to the measurement signal in the pickup signal) may be reduced, and the S/N ratio may also be lowered.

In the second embodiment, there is provided a viewing system capable of accurately measuring the user's viewing position, even if at least one of the characteristics of the audio output system and the pickup system is unknown.

(3-1. Configuration of System)

A configuration of a viewing system according to the second embodiment of the present disclosure will be described with reference to FIG. 12. Herein, the viewing system according to the second embodiment corresponds to a change in the functions of the measurement processing unit 420 in the configuration of the viewing system 1 illustrated in FIG. 1. Consequently, in the following description of the viewing system according to the second embodiment, the functions of the measurement processing unit that differ from the first embodiment will be described primarily, whereas detailed description will be reduced or omitted for items that overlap with the first embodiment.

Figure 12:
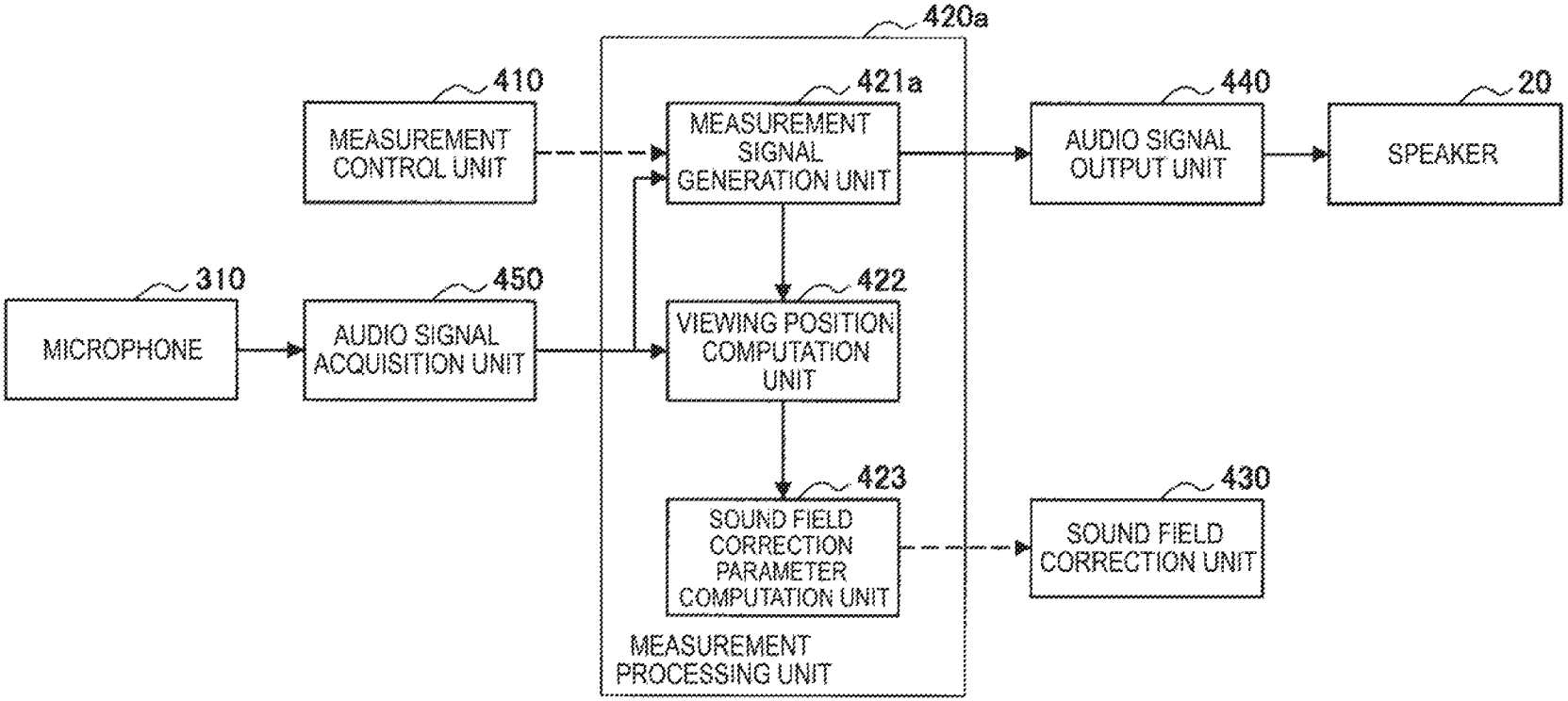
FIG. 12 is a block diagram illustrating one example configuration of a measurement processing unit that differs from a first embodiment in a viewing system according to a second embodiment.

FIG. 12 is a block diagram illustrating one example configuration of a measurement processing unit that differs from a first embodiment in a viewing system according to a second embodiment. Referring to FIG. 12, functionally, the measurement processing unit 420*a* according to the second embodiment includes a measurement signal generation unit 421*a*, a viewing position computation unit 422, and a sound field correction parameter computation unit 423. Note that in FIG. 12, the functional components of the measurement processing unit 420*a* are illustrated jointly with selected components related to each function of the measurement processing unit 420*a* from among the components of the viewing system according to the second embodiment (which is configured similarly to the viewing system 1 according to the first embodiment illustrated in FIG. 1, except for the measurement processing unit 420 being changed to the measurement processing unit 420*a*). Additionally, since the functions of the viewing position computation unit 422 and the sound field correction parameter computation unit 423 are similar to the first embodiment, detailed description thereof will be reduced or omitted. Note that each function in the measurement processing unit 420*a* may be realized by having any of various processors constituting the measurement processing unit 420*a* operate by following a certain program.

The measurement signal generation unit 421*a* generates a measurement signal according to the measurement control signal provided by the measurement control unit 410. Note that, similarly to the first embodiment, the measurement signal generated by the measurement signal generation unit 421*a* may be the measurement signal H(n) indicated in Math. 1 to Math. 3 above, for example. However, in the second embodiment, the measurement signal generation unit 421*a* has a function of adjusting the characteristics of the measurement signal H(n) according to the signal level (S/N ratio) in an inaudible band of the pickup signal acquired by the audio signal acquisition unit 450 (in other words, the signal level (S/N ratio) of the component corresponding to the measurement signal in the pickup signal). Specifically, the measurement signal generation unit 421*a* determines whether or not the signal level in the inaudible band of the pickup signal is suitable, and according to the determination result, is able to adjust the volume level and/or the frequency band of the measurement signal H(n). The adjustment of the frequency band may be realized by adjusting the lower limit frequency $f_0$ illustrated in Math. 3 above, for example. The measurement signal H(n) with the volume level and/or the frequency band adjusted by the measurement signal generation unit 421*a* is output from the speaker 20 via the audio signal output unit 440.

For example, the measurement signal generation unit 421*a* is able to determine whether or not the signal level of the component in the inaudible band of the pickup signal is suitable by making the determination indicating in Math. 13 below.

[Math. 13]

$$\begin{cases} \dfrac{P_{inaudible}}{P_{audible}} \geq th_p \Rightarrow OK \\ \dfrac{P_{inaudible}}{P_{audible}} < th_p \Rightarrow NG \end{cases} \tag{13}$$

Herein, $P_{inaudible}$ is the signal level of the inaudible band component of the pickup signal, while $P_{audible}$ is the signal level of the audible band component of the pickup signal. Also, $th_p$ is a certain threshold value. In this way, the measurement signal generation unit 421*a* is able to determine whether or not the signal level $P_{inaudible}$ of the inaudible band component of the pickup signal is suitable by comparing the signal level $P_{inaudible}$ of the inaudible band component of the pickup signal to the signal level $P_{audible}$ of the audible band component of the pickup signal. Note that if an audible band component does not exist in the pickup signal (in other words, in the case in which the measurement signal is not superimposed onto a music signal, but instead only the measurement signal is being output from the speaker 20), or if there is sudden variation in the signal level of the audible band component of the pickup signal, whether or not $P_{inaudible}$ is suitable or not may be determined by using only the signal level $P_{inaudible}$ of the inaudible band component of the pickup signal, and comparing $P_{inaudible}$ directly to a certain threshold value.

As another example, the measurement signal generation unit 421*a* is able to determine whether or not the signal level of the component in the inaudible band of the pickup signal is suitable by using a signal obtained by performing synchronous averaging and also applying the bandpass filter characteristics W(n) to the pickup signal, and convolving the inverse characteristics $H^{-1}$ in the band at or above the frequency $f_0$ of the measurement signal H(n) (in other words, a signal to which the inverse characteristics $M^{-1}$ of the microphone in Math. 8 above are not applied). Specifically, the measurement signal generation unit 421*a* compares the ratio of the maximum value and the average value of the absolute value of the magnitude of this signal (see Math. 14 below) to a certain threshold value, and if the ratio indicated in Math. 14 below is equal to or greater than the threshold value, the measurement signal generation unit 421*a* is able to determine that the signal level of the component in the inaudible band of the pickup signal is suitable, whereas if the ratio is less than the threshold value, the measurement signal generation unit 421*a* is able to determine that the signal level of the component in the inaudible band of the pickup signal is not suitable.

[Math. 14]

$$\frac{\max_n\left(\left|m(n) * w(n) * g_{i'j}(n)\right|\right)}{\overline{\left|m(n) * w(n) * g_{i'j}(n)\right|}} \tag{14}$$

In this way, in the second embodiment, the measurement of the user's viewing position is conducted by using a measurement signal H(n) for which the volume level and/or the frequency band has been adjusted suitably by the measurement signal generation unit 421*a*. Consequently, even if at least one of the characteristics of the audio output system and the pickup system is unknown, and the signal level of the component corresponding to the measurement signal in the pickup signal is lowered, the volume level and/or the frequency band of the measurement signal H(n) is adjusted suitably, thereby making it possible to measure the user's viewing position more accurately.

(3-2. Information Processing Method)

Figure 13A:
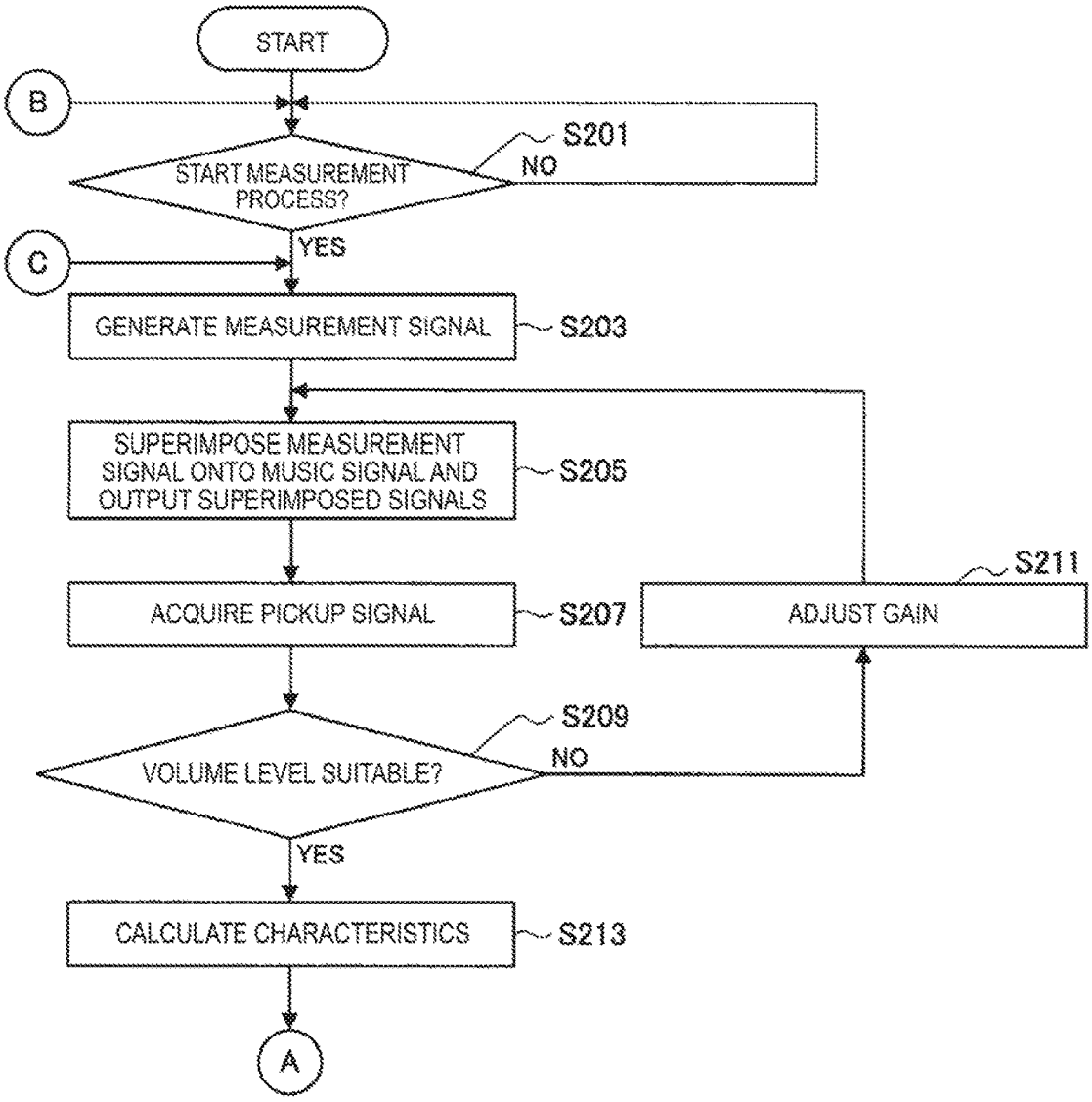
FIG. 13A is a flowchart illustrating an example of a processing procedure of an information processing method according to a second embodiment.
Figure 13B:
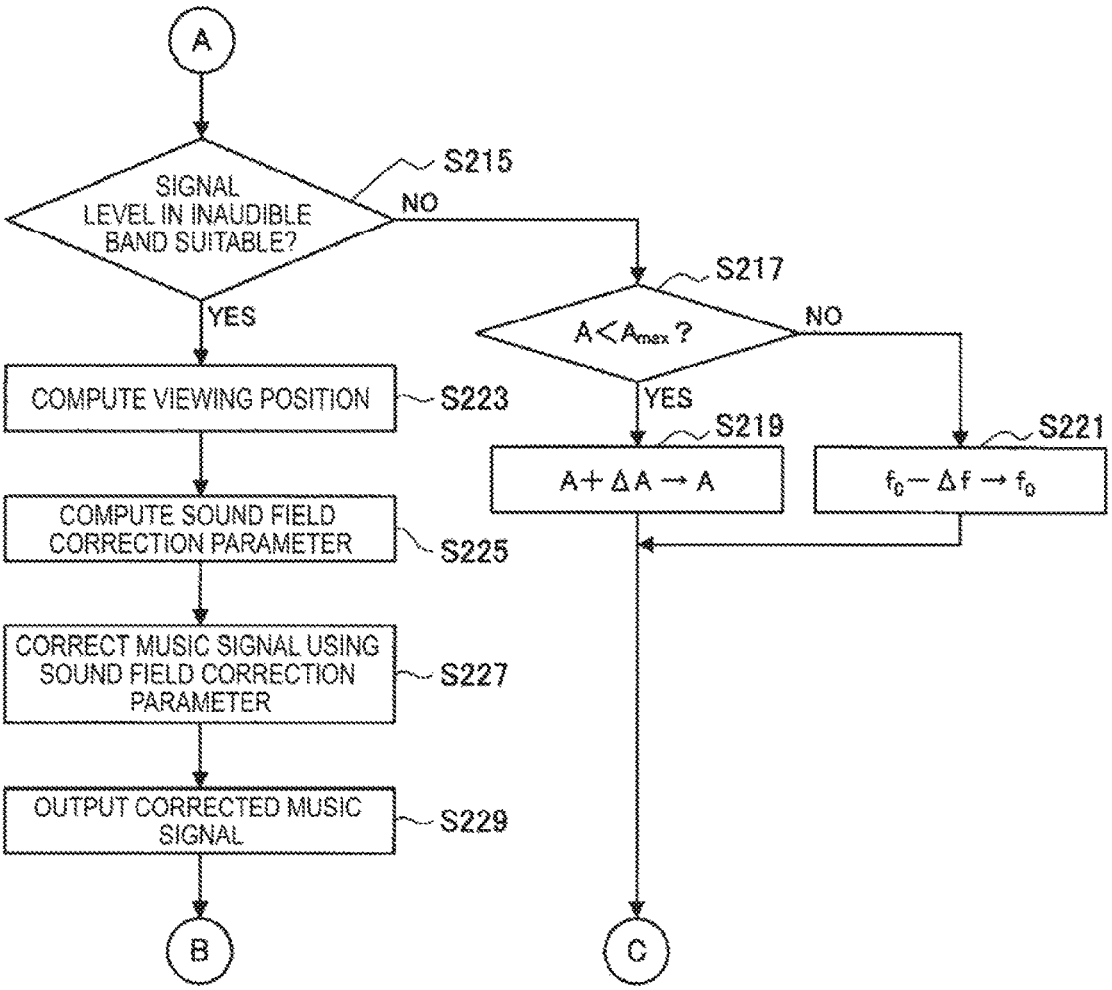
FIG. 13B is a flowchart illustrating an example of a processing procedure of an information processing method according to a second embodiment.

A processing procedure of an information processing method which may be executed in the viewing system according to the second embodiment will be described with reference to FIGS. 13A and 13B. FIGS. 13A and 13B are flowcharts illustrating an example of a processing procedure of an information processing method according to the second embodiment. Note that the information processing method according to the second embodiment corresponds to the information processing method according to the first embodiment illustrated in FIG. 10 with the addition of several processes. Consequently, in the following description of the information processing method according to the second embodiment, the points that differ from the first embodiment will be described primarily, whereas detailed description will be reduced or omitted for items that overlap with the first embodiment.

Referring to FIG. 13A, in the information processing method according to the second embodiment, first, it is determined whether or not to start the measurement process, based on a certain condition (step S201). If it is determined to start the measurement process, a measurement signal is generated (step S203), and the generated measurement signal is superimposed onto a music signal and output from the speaker 20 (step S205). Subsequently, a pickup signal corresponding to the music signal superimposed with the measurement signal is acquired (step S207). At this point, the gain may be adjusted suitably according to the volume level of the pickup signal (steps S209, S211). Note that the processes indicated from step S201 to step S211 are similar to the processes indicated from step S101 to step S111 in the first embodiment illustrated in FIG. 10 discussed earlier, and for this reason a detailed description is omitted.

In the second embodiment, next, the characteristics of the pickup signal are calculated (step S213), and based on the calculated characteristics, it is determined whether or not the signal level (the S/N ratio, for example) of the inaudible band of the pickup signal is suitable (step S215). The processes indicated in steps S213 and S215 may be executed by the measurement signal generation unit 421*a* illustrated in FIG. 12 discussed earlier, for example. In steps S213 and S215, the values indicated in Math. 13 and Math. 14 above are calculated for the pickup signal, for example, and it is determined whether or not the signal level of the inaudible band of the pickup signal is suitable.

In step S215, if it is determined that the signal level of the inaudible band of the pickup signal is not suitable, the flow proceeds to step S217, and it is determined whether or not a parameter A indicating the volume level of the measurement signal (see Math. 2 above) is less than a maximum value $A_{max}$ corresponding to the maximum volume level in the audio output system. If the parameter A is less than the maximum value $A_{max}$, the parameter A is replaced by $A+\Delta A$ (in other words, the volume level of the measurement signal is increased by $\Delta A$). Subsequently, the flow returns to step S203, a measurement signal is generated with the parameter A in the increased state, and the series of processes from step S205 to step S215 is executed again. By increasing the volume level of the measurement signal, the signal level of the inaudible band of the pickup signal is expected to increase more and become suitable.

On the other hand, in step S217, if the parameter A is not less than the maximum value $A_{max}$ (in other words, is equal to the maximum value $A_{max}$), the volume level of the measurement signal cannot be increased any further. In this case, the flow proceeds to step S221, and the lower limit frequency $f_0$ of the measurement signal is replaced by $f_0-\Delta f$ (in other words, the lower limit of the frequency band of the measurement signal is lowered by $\Delta f$). Subsequently, the flow returns to step S203, a measurement signal is generated with the lower limit frequency $f_0$ in the lowered state, and the series of processes from step S205 to step S215 is executed again. By lowering the lower limit frequency $f_0$ of the measurement signal, the frequency band of the measurement signal widens and thus the measurement signal is more likely to be included in the playback band of the speaker 20 and/or the pickup band of the microphone 310, and the signal level of the inaudible band of the pickup signal is expected to increase more and become suitable.

In step S215, if it is determined that the signal level of the inaudible band of the pickup signal is suitable, the pickup signal is used to compute the user's viewing position (step S223), and a sound field correction parameter is computed based on the computed viewing position (step S225). Subsequently, the music signal is corrected based on the computed sound field correction parameter (step S227), and the corrected music signal is output from the speaker 20 (step S229). Note that the processes indicated from step S223 to step S229 are similar to the processes indicated from step S113 to step S119 in the first embodiment illustrated in FIG. 10 discussed earlier, and for this reason a detailed description is omitted.

The above thus describes an information processing method according to the second embodiment with reference to FIGS. 13A and 13B. As described above, according to the second embodiment, even if at least one of the characteristics of the audio output system and the pickup system is unknown (for example, if the characteristics of the speaker 20 or the microphone 310 are unknown), the characteristics of the measurement signal are varied adaptively, thereby making it possible to measure the viewing position without causing the user to perceive the measuring audio or feel uncomfortable.

(4. Modifications)

Several modifications of the first and second embodiments described above will be described. Note that although the following describes modifications of the first embodiment above as an example, a configuration according to the modifications described below are applicable similarly to the second embodiment above.

(4-1. Modification of Measurement Control Signal)

First, a modification of the measurement control signal will be described. In the first and second embodiments described above, the measurement control unit 410 outputs the measurement control signal based on information such as information indicating operating input on the mobile terminal 30, information indicating the movement state of the mobile terminal 30, and/or information about the playback status of music content, for example. However, the first and second embodiments are not limited to such an example, and the measurement control unit 410 may also output a measurement control signal based on other information.

Herein, generally, an audio signal in an inaudible band is not perceived directly by the user, but may also be said to influence factors such as the smoothness of the music signal, and some users may demand that the audio signal is not output more than necessary during music playback. Accordingly, the present modification provides a method of reducing the influence of the measurement signal on the music signal by deciding timings at which to output a measurement control signal according to the audio signal in the audible band (that is, the music signal).

Herein, since the configuration of a viewing system according to the present modification may be realized with a configuration similar to the viewing system 1 according to the first embodiment illustrated in FIG. 1, a detailed description is omitted. In the present modification, the measurement control unit 410 is able to decide timings at which to output a measurement control signal, based on a music signal received from the content playback unit 10. Specifically, the measurement control unit 410 is able to analyze the music signal, detect timings corresponding to the gaps between songs based on characteristics such as the volume level and the frequency characteristics of the music signal, for example, and output a measurement control signal at the timings corresponding to the gaps between songs. The timings corresponding to the gaps between songs may be detected by, for example, detecting features such as silence or audio that is different from the original music (such as cheering, for example). Consequently, a measurement signal is output from the speaker 20 when a gap between songs is detected, and the influence of the measurement signal on the music signal may be reduced.

However, if the duration of a single song is long, there is a possibility that only conducting the measurement process between songs may be inadequate as the frequency of measurement. Accordingly, to reduce the influence of the measurement signal with what is called a masking effect, the measurement control unit 410 may also output a measurement control signal when the volume level of the music signal is sufficiently high during a song (for example, when the volume level is higher than a certain threshold value). Consequently, a measurement signal is output from the speaker 20 when the volume level of the music signal is sufficiently high, and the influence of the measurement signal on the music signal may be reduced.

Figure 14:
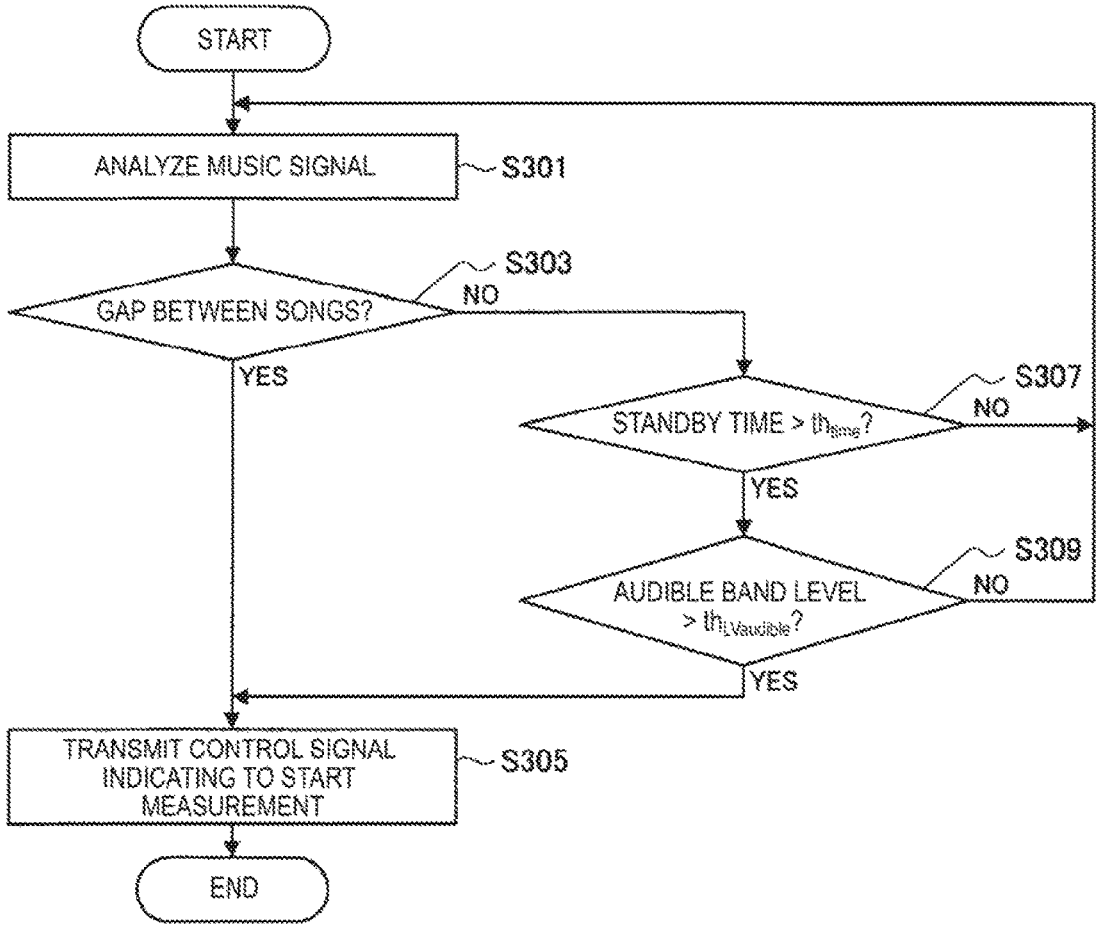
FIG. 14 is a flowchart illustrating an example of a processing procedure of an information processing method according to a modification.
Figure 15:
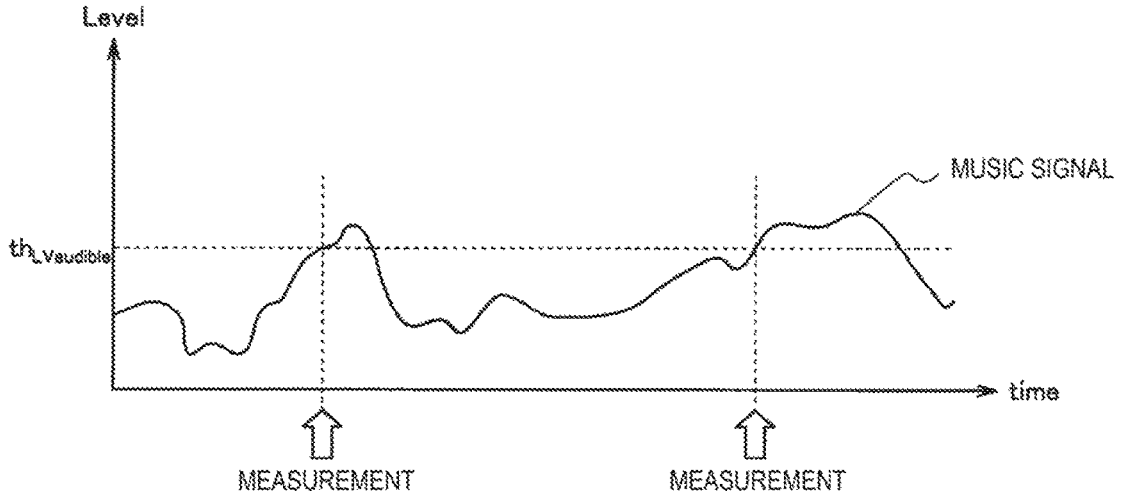
FIG. 15 is an explanatory diagram for explaining an example of output timings of a measurement control signal in a modification in which the output timings of the measurement control signal are different.

A processing procedure of such an information processing method according to the present modification will be described with reference to FIG. 14. FIG. 14 is a flowchart illustrating an example of a processing procedure of an information processing method according to the present modification. Also, FIG. 15 is an explanatory diagram for explaining an example of output timings of a measurement control signal in a modification in which the output timings of the measurement control signal are different. Note that the respective processes in the flowchart illustrated in FIG. 14 may be executed by the measurement control unit 410 illustrated in FIG. 1, for example.

Referring to FIG. 14, in the information processing method according to the present modification, first, a music signal is analyzed (step S301). In the process indicated in step S301, characteristics such as the volume level and the frequency of the music signal are analyzed, for example, and silence or audio that is different from the original music (such as cheering, for example) which may indicate gaps between songs may be detected.

Next, it is determined whether or not the current timing in the music signal is a gap between songs, based on the music signal analysis result (step S303). For example, if silence or cheering as discussed above is detected as a result of analyzing the music signal, it may be determined that the current timing is a gap between songs. If it is determined that the current timing is a gap between songs, the flow proceeds to step S305, and a control signal indicating to start measurement (in other words, a measurement control signal) is transmitted to the measurement processing unit 420. In this way, by detecting silence or cheering from a music signal, outputting a measurement control signal at a timing that may be inferred to be a gap between songs, and starting the measurement process, the influence of the measurement signal on the music signal may be reduced.

On the other hand, in step S303, if it is determined that the current timing is not a gap between songs, the flow proceeds to step S307. In step S307, it is determined whether or not a standby time during which the measurement control signal is not output (in other words, a time during which the measurement process is not conducted) is greater than a certain threshold value ($th_{time}$). Herein, the threshold value $th_{time}$ is an indicator expressing an appropriate measurement frequency, and $th_{time}$ may be set to a value whereby the measurement frequency of the user's viewing position is determined to be inadequate if the execution interval of the measurement process becomes greater than $th_{time}$. If the standby time is less than or equal to the threshold value $th_{time}$, not yet conducting the measurement process is not considered to be a problem from the perspective of measurement frequency, and thus the flow returns to step S301, and the processes from step S301 are executed again.

On the other hand, in step S307, if the standby time is greater than the threshold value $th_{time}$, conducting the measurement process even if not in a gap between songs is considered to be better from the perspective of measurement frequency, and thus the flow proceeds to step S309. In step S309, it is determined whether or not the volume level of the audible band of the music signal is greater than a certain threshold value ($th_{LVaudible}$). At this point, the threshold value $th_{LVaudible}$ may be set to a value so that, from the perspective of what is called a masking effect, the influence of the measurement signal on the music signal is sufficiently small when the measurement signal is superimposed onto the music signal and output from the speaker 20. If the volume level of the audible band of the music signal is less than or equal to the threshold value $th_{LVaudible}$, there is a possibility that the influence of the measurement signal may become large when the measurement signal is superimposed onto the music signal, and thus the flow returns to step S301, and the processes from step S301 are executed again.

On the other hand, in step S309, if the volume level of the audible band of the music signal is greater than the threshold value $th_{LVaudible}$, it is considered that the influence of the measurement signal may be reduced further, even if the measurement signal is superimposed onto the music signal. Consequently, the flow proceeds to step S305, and a measurement control signal is transmitted to the measurement processing unit 420. FIG. 15 illustrates an example of output timings of a measurement control signal based on the process indicated in step S309. As illustrated in FIG. 15, according to the present modification, if a music signal without silence or cheering continues for a long duration, a measurement control signal may be output at timings when the music signal exceeds the certain threshold value $th_{LVaudible}$ and the masking effect is anticipated. In this way, if a song has a long duration, a measurement signal is output and measurement is started at timings when the volume level of the music signal is sufficiently high, even if not in a gap between songs, thereby making it possible to maintain a sufficient measurement frequency while still reducing the influence of the measurement signal on the music signal.

The above thus describes a modification of the measurement control signal. As described above, according to the present modification, the music signal is analyzed, at the measurement process is executed at timings when the influence of the measurement signal on the music signal is smaller, such as the timings of gaps between songs or when the music signal is sufficiently large. Consequently, the influence of the measurement signal on the music signal may be reduced, making it possible to measure the user's viewing position without interfering with the viewing of music content.

(4-2. Modification of Device Configuration)

Next, a modification of the device configuration will be described. In the first and second embodiments described earlier, the major processes related to the measurement process (such as the generation of the measurement signal, the computation of the viewing position by analyzing the pickup signal, and the computation of a sound field correction parameter, for example) are executed by the acoustic control device 40, which is an AV amp, for example. However, the first and second embodiments are not limited to such an example. The specific device configuration that realizes a viewing system according to the first or second embodiment may be arbitrary, and is not limited to the examples illustrated in drawings such as FIGS. 1 and 5.

Figure 16:
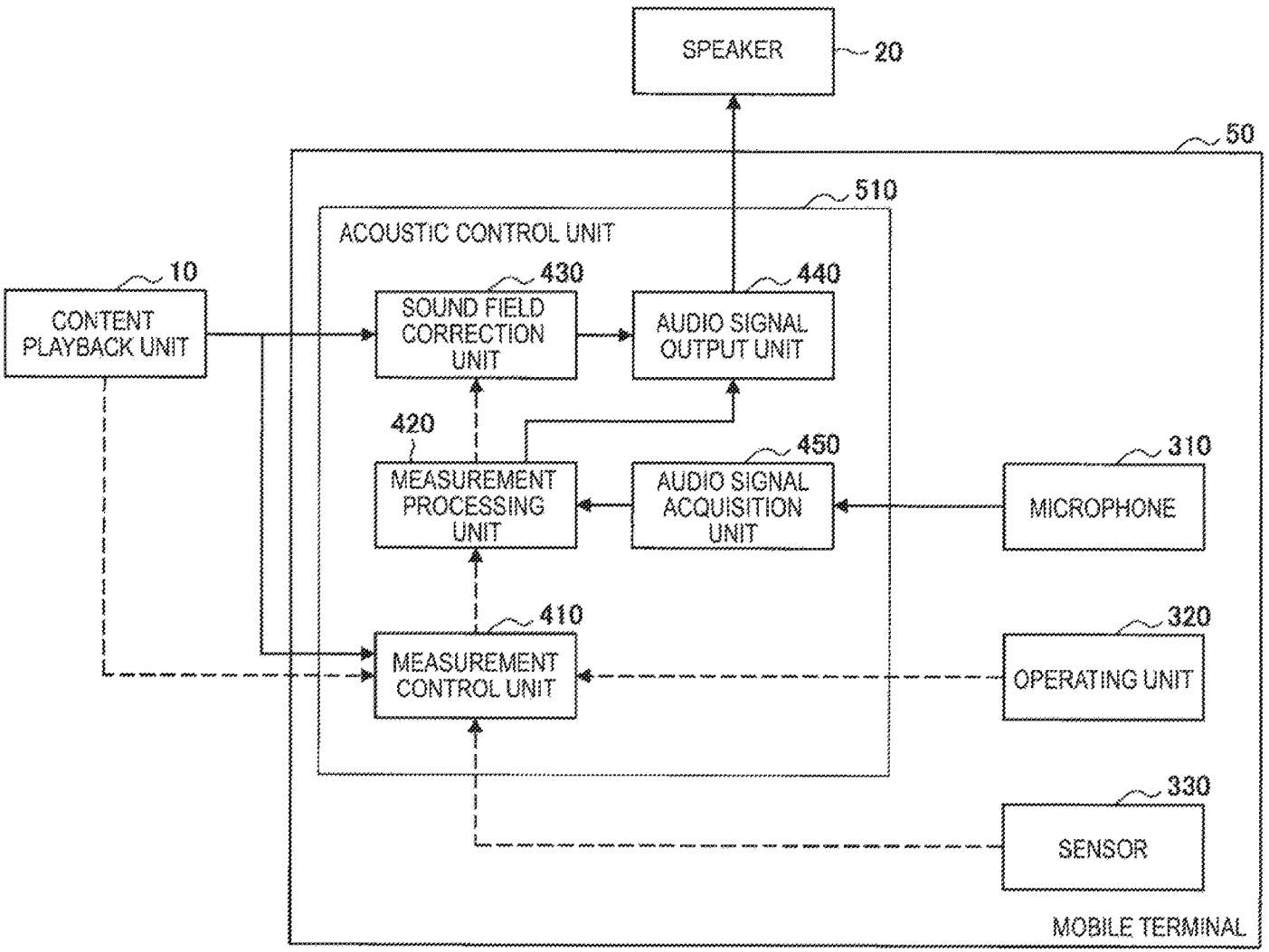
FIG. 16 is a block diagram illustrating one example configuration of a viewing system according to a modification in which the device configuration is different.

An example configuration of a viewing system according to the present modification will be described with reference to FIG. 16. FIG. 16 is a block diagram illustrating one example configuration of a viewing system according to a modification in which the device configuration is different. Note that the configuration of the viewing system illustrated in FIG. 16 realizes the functions of the viewing system 1 according to the first embodiment illustrated in FIG. 1 with a difference device configuration, and processes which may be executed as the overall viewing system illustrated in FIG. 16 are similar to the viewing system 1 illustrated in FIG. 1. Consequently, in the following description of the viewing system according to the present modification, the differences from the viewing system 1 according to the first embodiment will be described primarily, whereas detailed description will be reduced or omitted for items that overlap.

Referring to FIG. 16, the viewing system 3 according to the present modification is equipped with a content playback unit 10, a speaker 20, and a mobile terminal 50. Herein, since the functions of the content playback unit 10 and the speaker 20 are similar to the respective functions of these components illustrated in FIG. 1, detailed description will be omitted.

Functionally, the mobile terminal 50 includes a microphone 310, an operating unit 320, a sensor 330, and an acoustic control unit (which corresponds to an information processing device of the present disclosure) 510. Herein, since the functions of the microphone 310, the operating unit 320, and the sensor 330 are similar to the respective functions of these components illustrated in FIG. 1, detailed description will be omitted.

Functionally, the acoustic control unit 510 includes a measurement control unit 410, a measurement processing unit 420, a sound field correction unit 430, an audio signal output unit 440, and an audio signal acquisition unit 450. Herein, the functions of the measurement processing unit 420, the sound field correction unit 430, the audio signal output unit 440, and the audio signal acquisition unit 450 are similar to the respective functions of these components illustrated in FIG. 1. In this way, the present modification corresponds to the mobile terminal 50 with the functions of the acoustic control device 40 illustrated in FIG. 1. Note that the respective functions of the acoustic control unit 510 may be realized by having any of various processors constituting the acoustic control unit 510 operate by following a certain program.

The above thus describes a configuration of the viewing system 3 according to the present modification. As described above, the viewing system 1 according to the first embodiment is also realizable with a device configuration as illustrated in FIG. 16, for example.

Herein, the example configuration illustrated in FIG. 16 is one modification of the device configuration for realizing a viewing system according to the first or second embodiment. The device configuration that may realize a viewing system according to the first or second embodiment is not limited to the configurations illustrated in drawings such as FIGS. 1 and 5 or the configuration indicated in the present modification, and may also be arbitrary. For example, in the device configuration illustrated in FIG. 1, the content playback unit 10, the speaker 20, and the acoustic control device 40 may also be configured as an integrated device. In cases in which the content playback unit 10, the speaker 20, and the acoustic control device 40 are configured as an integrated device, such a device may be what is called a television set capable of playing back various types of content.

As another example, in the device configuration illustrated in FIG. 16, the content playback unit 10 and the mobile terminal 50 may also be configured as an integrated device. In cases in which the content playback unit 10 and the mobile terminal 50 are configured as an integrated device, the mobile terminal 50 additionally has the function of a playback device that plays back various types of content, in which a music signal and/or a measurement signal may be transmitted from the mobile terminal 50 to the speaker 20 by wireless communication according to a communication scheme such as Bluetooth (registered trademark), for example, and the music signal and/or the measurement signal may be output from the speaker 20.

Note that the various signal processing in a viewing system according to the first or second embodiment and each modification described above (for example, the processing executed by the measurement control unit 410, the measurement processing units 420 and 420*a*, the sound field correction unit 430, the audio signal output unit 440, and the audio signal acquisition unit 450) may be executed by one processor or one information processing device, or be executed by the cooperative action of multiple processors or multiple information processing devices, for example. Alternatively, the signal processing may be executed by an information processing device or an information processing device group such as a server provided over a network (what is also referred to as in the cloud, for example). In this case, the series of processes in the viewing systems 1 and 3 may be realized by providing the speaker 20 and the microphone 310 in the location where the user views content, such as inside the home, for example, and having these components communicate various information, instructions, and the like over a network with an information processing device installed in another location.

(5. Hardware Configuration)

Figure 17:
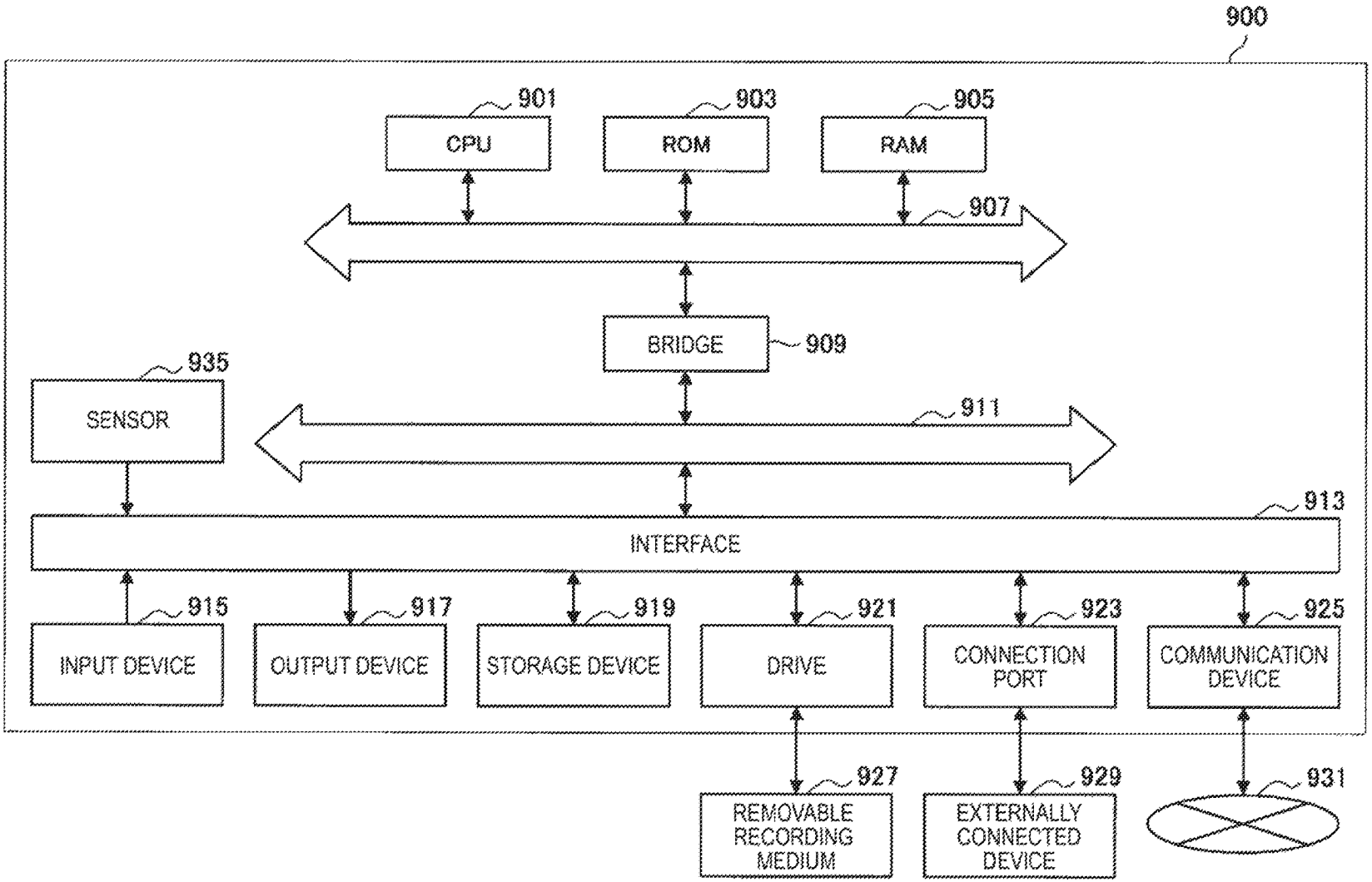
FIG. 17 is a block diagram illustrating an example of a hardware configuration of an information processing device according to an embodiment.

Next, a hardware configuration of an image processing device according to the present embodiment will be described with reference to FIG. 17. FIG. 17 is a block diagram illustrating an example of a hardware configuration of an information processing device according to the present embodiment. The information processing device 900 illustrated in the drawing may realize the configuration of the acoustic control device 40 or the mobile terminals 30 and 50 in the first or second embodiment and each modification described earlier, for example.

The information processing device 900 includes a CPU 901, read-only memory (ROM) 903, and random access memory (RAM) 905. The information processing device 900 may also include a host bus 907, a bridge 909, an external bus 911, an interface 913, an input device 915, an output device 917, a storage device 919, a drive 921, a connection port 923, a communication device 925, and a sensor 935. The information processing device 900 may also include a processing circuit called a DSP or an application-specific integrated circuit (ASIC) instead of, or together with, the CPU 901.

The CPU 901 functions as a computational processing device and a control device, and controls all or part of the operation in the information processing device 900 by following various programs recorded in the ROM 903, the RAM 905, the storage device 919, or a removable recording medium 927. The ROM 903 stores information such as programs and computational parameters used by the CPU 901. The RAM 905 temporarily stores information such as programs used during execution by the CPU 901, and parameters that change as appropriate during such execution. The CPU 901, the ROM 903, and the RAM 905 are connected to each other by the host bus 907, which is realized by an internal bus such as a CPU bus. Additionally, the host bus 907 is connected to an external bus 911 such as a Peripheral Component Interconnect/Interface (PCI) bus via the bridge 909. In the present embodiment, the CPU 901 corresponds to the respective functions of the acoustic control device 40 illustrated in FIG. 1, the measurement processing unit 420*a* illustrated in FIG. 5, the acoustic control unit 510 illustrated in FIG. 5, and the like, for example.

The input device 915 is a device operated by a user, such as a mouse, a keyboard, a touch panel, or one or more buttons, switches, and levers, for example. The input device 915 may also be a remote control device utilizing infrared or some other electromagnetic wave, and may also be an externally connected device 929 such as a mobile phone associated with the operation of the information processing device 900, for example. The input device 915 includes an input control circuit that generates an input signal on the basis of information input by the user, and outputs the generated input signal to the CPU 901. The input device 915 may also be a speech input device such as a microphone. By operating the input device 915, the user inputs various data and instructs the information processing device 900 to perform processing operations, for example. In the present embodiment, the input device 915 corresponds to the operating units of the mobile terminals 30 and 50 illustrated in FIGS. 1 and 16, for example. As another example, the input device 915 may correspond to the microphone 310 of the mobile terminals 30 and 50 illustrated in FIGS. 1 and 16.

The output device 917 is realized by a device capable of visually or aurally reporting acquired information to a user. The output device 917 may be a display device such as an LCD, a plasma display panel (PDP), an organic EL display, a lamp, or a light, an audio output device such as one or more speakers and headphones, or another device such as a printer, for example. The output device 917 may output results obtained from processing by the information processing device 900 in the form of visual information such as text or an image, or in the form of audio such as speech or sound. For example, in the device configuration illustrated in FIG. 1, if the content playback unit 10, the speaker 20, and the acoustic control device 40 are configured as an integrated device, the audio output device corresponds to the speaker 20 in such a device.

The storage device 919 is a device used for data storage, realized as an example of storage in the information processing device 900. The storage device 919 may be a magnetic storage device such as a hard disk drive (HDD), a semiconductor storage device, an optical storage device, or a magneto-optical storage device, for example. The storage device 919 stores information such as programs executed by the CPU 901, various data, and various externally acquired data. In the present embodiment, the storage device 919 is able to store the various types of information processed by the respective functions of the acoustic control device 40 illustrated in FIG. 1, the measurement processing unit 420*a* illustrated in FIG. 5, the acoustic control unit 510 illustrated in FIG. 16, and the like, as well as various processing results from these components. For example, the storage device 919 is able to store information such as a music signal input from the content playback unit 10, a generated measurement signal, a computed user's viewing position, and a computed sound field correction parameter.

The drive 921 is a reader/writer for a removable recording medium 927 such as a magnetic disk, an optical disc, a magneto-optical disc, or semiconductor memory, and is built into or externally attached to the information processing device 900. The drive 921 retrieves information recorded in an inserted removable recording medium 927, and outputs the retrieved information to the RAM 905. Additionally, the drive 921 writes information to an inserted removable recording medium 927. For example, in the device configuration illustrated in FIG. 1, if the content playback unit 10, the speaker 20, and the acoustic control device 40 are configured as an integrated device, the drive 921 corresponds to the content playback unit 10 in such a device. The drive 921 is able to read out and play back content recorded on the removable recording medium 927. As another example, the drive 921 is able to read out from the removable recording medium 927, or write to the removable recording medium 927, the various types of information processed by the respective functions of the acoustic control device 40 illustrated in FIG. 1, the measurement processing unit 420*a* illustrated in FIG. 5, the acoustic control unit 510 illustrated in FIG. 16, and the like, as well as various processing results from these components.

The connection port 923 is a port for connecting equipment directly to the information processing device 900. The connection port 923 may be a Universal Serial Bus (USB) port, an IEEE 1394 port, or a Small Computer System Interface (SCSI) port, for example. The connection port 923 may also be an RS-232C port, an optical audio socket, or a High-Definition Multimedia Interface (HDMI™) port. By connecting an externally connected device 929 to the connection port 923, various data may be exchanged between the information processing device 900 and the externally connected device 929. For example, if the information processing device 900 corresponds to the acoustic control device 40 illustrated in FIG. 1, the content playback unit 10 which corresponds to the externally connected device 929 and the speaker 20 may be connected via the information processing device 900 and the connection port 923. As another example, the various types of information processed by the respective functions of the acoustic control device 40 illustrated in FIG. 1, the measurement processing unit 420*a* illustrated in FIG. 5, the acoustic control unit 510 illustrated in FIG. 16, and the like, as well as various processing results from these components, may be transmitted and received to and from the externally connected device 929 via the connection port 923.

The communication device 925 is a communication interface realized by a communication device that connects to a communication network 931, for example. The communication device 925 may be a device such as a wired or wireless local area network (LAN), Bluetooth, or Wireless USB (WUSB) communication card, for example. The communication device 925 may also be an optical communication router, an asymmetric digital subscriber line (ADSL) router, or a modem for any of various types of communication. The communication device 925 transmits and receives signals or other information to and from the Internet or another communication device using a given protocol such as TCP/IP, for example. Also, the communication network 931 connected to the communication device 925 is a network connected in a wired or wireless manner, and may be the Internet, a home LAN, infrared communication, radio-wave communication, or satellite communication, for example. In the present embodiment, the configuration corresponding to the communication device 925 may be provided in the mobile terminal 30 and the acoustic control device 40 illustrated in FIG. 1, and the mobile terminal 30 and the acoustic control device 40 may transmit and receive various types of information to and from each other via the communication device 925, for example. As another example, the communication device 925 may transmit and receive the various types of information processed by the respective functions of the acoustic control device 40 illustrated in FIG. 1, the measurement processing unit 420*a* illustrated in FIG. 5, the acoustic control unit 510 illustrated in FIG. 16, and the like, as well as various processing results from these components, to and from other external equipment via the communication network 931.

The sensor 935 is any of various sensors such as an acceleration sensor, a gyro sensor, a geomagnetic sensor, an optical sensor, a sound sensor, or a range finding sensor, for example. The sensor 935 acquires information regarding the state of the information processing device 900 itself, such as the orientation of the case of the information processing device 900, as well as information regarding the environment surrounding the information processing device 900, such as the brightness or noise surrounding the information processing device 900, for example. The sensors 935 may also include a GPS sensor that receives GPS signals and measures the latitude, longitude, and altitude of the device. In the present embodiment, the sensor 935 corresponds to the sensor 330 of the mobile terminals 30 and 50 illustrated in FIGS. 1 and 16, for example.

The foregoing thus illustrates an exemplary hardware configuration of the information processing device 900. Each of the above structural elements may be realized using general-purpose members, but may also be realized in hardware specialized in the function of each structural element. Such a configuration may also be modified as appropriate according to the technological level at the time of the implementation.

Note that a computer program for realizing the respective functions of the information processing device 900 as discussed above (for example, functions such as the acoustic control device 40, the measurement processing unit 420*a*, and the acoustic control unit 510 in the first and second embodiments as well as each modification discussed earlier) may be created and implemented in a PC or the like. In addition, a computer-readable recording medium storing such a computer program may also be provided. The recording medium may be a magnetic disc, an optical disc, a magneto-optical disc, or flash memory, for example. Furthermore, the above computer program may also be delivered via a network, for example, without using a recording medium.

(6. Supplemental Remarks)

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art based on the description of this specification.

For example, the various processes and functions in the first and second embodiments as well as each modification described earlier may also be executed in arbitrary combinations with each other to the extent that such combinations are mutually feasible. By executing the various processes and functions according to each embodiment and each modification in arbitrary combinations, it becomes possible to obtain multiply the advantageous effects obtained by each of the embodiments and each of the modifications.

Additionally, the present technology may also be configured as below.

(1)

An information processing device, including:

an audio signal output unit that causes measuring audio in an inaudible band to be output from a speaker; and a viewing position computation unit that computes a viewing position of a user based on the measuring audio picked up by a microphone.

(2)

The information processing device according to (1), wherein a music signal in an audible band is corrected based on the computed viewing position of the user.

(3)

The information processing device according to (2), wherein at least one of a delay amount, a volume level, and frequency characteristics of the music signal is corrected.

(4)

The information processing device according to any one of (1) to (3), wherein the audio signal output unit superimposes the measuring audio and audio corresponding to a music signal in an audible band, and causes the superimposed audio to be output from the speaker.

(5)

The information processing device according to (4), wherein the microphone is provided on a mobile terminal, and if at least one of information indicating operating input performed on the mobile terminal by the user and information indicating a movement state of the mobile terminal is detected, the audio signal output unit superimposes the measuring audio and the audio corresponding to the music signal, and causes the superimposed audio to be output from the speaker.

(6)

The information processing device according to (4), wherein the audio signal output unit superimposes the measuring audio and the audio corresponding to the music signal according to a volume level of the music signal, and causes the superimposed audio to be output from the speaker.

(7)

The information processing device according to (6), wherein if a gap between songs is detected based on the volume level of the music signal, or if a level of the music signal is greater than, or greater than or equal to, a certain threshold value, the audio signal output unit superimposes the measuring audio and the audio corresponding to the music signal, and causes the superimposed audio to be output from the speaker.

(8)

The information processing device according to any one of (1) to (7), wherein characteristics of the measuring audio are adjusted according to a signal level of a component corresponding to the measuring audio in a pickup signal picked up by the microphone.

(9)

The information processing device according to (8), wherein a volume level of the measuring audio is adjusted if a signal level of a component corresponding to the measuring audio in the pickup signal is less than, or less than or equal to, a certain threshold value.

(10)

The information processing device according to (8) or (9), wherein a lower limit frequency of the measuring audio is adjusted if a signal level of a component corresponding to the measuring audio in the pickup signal is less than, or less than or equal to, a certain threshold value.

(11)

The information processing device according to any one of (1) to (10), wherein at least one of the speaker and the microphone is provided in plural.

(12)

The information processing device according to any one of (1) to (11), wherein the viewing position computation unit computes a position of the microphone indicating the viewing position of the user.

(13)

An information processing method, including:

causing, by a processor, measuring audio in an inaudible band to be output from a speaker; and computing, by a processor, a viewing position of a user based on the measuring audio picked up by a microphone.

(14)

A program causing a processor of a computer to realize:

a function of causing measuring audio in an inaudible band to be output from a speaker; and a function of computing a viewing position of a user based on the measuring audio picked up by a microphone.

REFERENCE SIGNS LIST

1, 3 viewing system
10 content playback unit
20 speaker
30, 50 mobile terminal
40 acoustic control device (information processing device)
410 measurement control unit
420, 420*a* measurement processing unit
421, 421*a* measurement signal generation unit
422 viewing position computation unit
423 sound field correction parameter computation unit
430 sound field correction unit
431 delay correction unit
432 volume correction unit
433 frequency correction unit
440 audio signal output unit
450 audio signal acquisition unit
510 acoustic control unit

The invention claimed is:

1. An information processing device, comprising:

an audio signal output unit configured to:

superimpose, based on a gap between songs in a music signal, a measuring audio in an inaudible band with a first audio corresponding to the music signal in an audible band, wherein the gap corresponds to one of a first portion of the music signal in which a first level of the music signal is below a first threshold value or a second portion of the music signal in which a second level of the music signal is above a second threshold value; and output the superimposed measuring audio from a speaker;

an audio signal acquisition unit configured to:

acquire, via a wireless communication, a first signal transmitted by a mobile terminal, wherein the mobile terminal is configured to acquire, by a microphone, the outputted superimposed measuring audio, and wherein the acquired first signal corresponds to the superimposed measuring audio acquired by the microphone; and a viewing position computation unit configured to compute a viewing position of a user based on the acquired first signal.

2. The information processing device according to claim 1, further comprising a sound field correction unit configured to correct the music signal based on the computed viewing position of the user.

3. The information processing device according to claim 2, wherein the sound field correction unit is further configured to correct at least one of a delay amount of the music signal, a volume level of the music signal, or frequency characteristics of the music signal.

4. The information processing device according to claim 1, wherein the audio signal output unit is further configured to superimpose the measuring audio and the first audio corresponding to the music signal, based on at least one of first information indicating a user input on the mobile terminal or second information indicating a movement state of the mobile terminal.

5. The information processing device according to claim 1, wherein the audio signal output unit is further configured to superimpose the measuring audio and the first audio corresponding to the music signal based on a volume level of the music signal.

6. The information processing device according to claim 1, further comprising a measurement processing unit configured to adjust characteristics of the measuring audio based on a signal level of a component in the first signal corresponding to the superimposed measuring audio acquired by the microphone.

7. The information processing device according to claim 6, wherein the measurement processing unit is further configured to adjust a volume level of the measuring audio based on the signal level of the component that is less than or equal to a third threshold value.

8. The information processing device according to claim 6, wherein the measurement processing unit is further configured to adjust a lower limit frequency of the measuring audio based on detection that the signal level of the component is less than or equal to a third threshold value.

9. The information processing device according to claim 1, further comprising a plurality of speakers.

10. The information processing device according to claim 1, wherein the viewing position computation unit is further configured to compute a position of the microphone as the viewing position of the user.

11. An information processing method, comprising:

in an information processing device:

superimposing, based on a gap between songs in a music signal, a measuring audio in an inaudible band with a first audio corresponding to the music signal in an audible band, wherein the gap corresponds to one of a first portion of the music signal in which a first level of the music signal is below a first threshold value or a second portion of the music signal in which a second level of the music signal is above a second threshold value;

outputting the superimposed measuring audio from a speaker;

acquiring via a wireless communication, a first signal transmitted by a mobile terminal, wherein the mobile terminal is configured to acquire, by a microphone, the outputted superimposed measuring audio, and wherein the acquired first signal corresponds to the superimposed measuring audio acquired by the microphone; and computing, a viewing position of a user based on the acquired first signal.

12. A non-transitory computer-readable medium having stored thereon computer-executable instructions that, when executed by a computer, cause a computer to execute operations, the operations comprising:

superimposing, based on a gap between songs in a music signal, a measuring audio in an inaudible band with a first audio corresponding to the music signal in an audible band, wherein the gap corresponds to one of a first portion of the music signal in which a first level of the music signal is below a first threshold value or a second portion of the music signal in which a second level of the music signal is above a second threshold value;

outputting the superimposed measuring audio from a speaker;

acquiring, via a wireless communication, a first signal transmitted by a mobile terminal, wherein the mobile terminal is configured to acquire, by a microphone, the outputted superimposed measuring audio, and wherein the acquired first signal corresponds to the superimposed measuring audio acquired by the microphone; and computing a viewing position of a user based on the acquired first signal.

* * * * *